US005647104A

United States Patent [19]

James

[11] Patent Number: 5,647,104

[45] Date of Patent: Jul. 15, 1997

[54] CABLE FASTENER

[75] Inventor: Laurence H. James, 166 Byram Shore Rd., Greenwich, Conn. 06830

[73] Assignee: Laurence H. James, Greenwich, Conn.

[21] Appl. No.: 566,180

[22] Filed: Dec. 1, 1995

[51] Int. Cl.[6] ..... A43B 11/00

[52] U.S. Cl. ..... 24/68 S; 36/50.1; 24/712.2; 24/71 SK; 24/69 SK

[58] Field of Search ..... 24/68 SK, 69 SK, 24/71 SK, 712.2, 712.3, 712.5; 36/50.1

[56] References Cited

U.S. PATENT DOCUMENTS

| | | | |
|---|---|---|---|
| 4,074,892 | 2/1978 | Harken | 254/188 |
| 4,130,949 | 12/1978 | Seidel | 36/50 |
| 4,149,540 | 4/1979 | Hasslinger | 128/327 |
| 4,222,184 | 9/1980 | Kastinger | 36/121 |
| 4,281,468 | 8/1981 | Giese et al. | 36/121 |
| 4,326,320 | 4/1982 | Riedel | 24/70 SK |
| 4,408,403 | 10/1983 | Martin | 36/115 |
| 4,569,108 | 2/1986 | Schwab | 24/17 R |
| 4,660,300 | 4/1987 | Morell et al. | 36/50 |
| 4,669,201 | 6/1987 | Pozzobon | 36/117 |
| 4,691,454 | 9/1987 | Ottieri | 24/68 SK X |
| 4,741,115 | 5/1988 | Pozzobon | 36/117 |
| 4,748,726 | 6/1988 | Schoch | 24/68 SK |
| 4,754,560 | 7/1988 | Nerrinck | 24/68 SK X |
| 4,761,859 | 8/1988 | Calabrigo | 24/68 SK |
| 4,790,081 | 12/1988 | Benoit et al. | 36/50 |
| 4,823,484 | 4/1989 | Couty | 24/68 SK X |
| 4,841,649 | 6/1989 | Baggio et al. | 36/117 |
| 4,864,698 | 9/1989 | Brame | 24/442 |
| 4,937,951 | 7/1990 | Loecker | 36/119 |
| 4,937,952 | 7/1990 | Olivieri | 36/119 |
| 5,003,711 | 4/1991 | Nerrinck et al. | 36/120 |
| 5,007,186 | 4/1991 | Bischof et al. | 24/68 SK X |
| 5,042,177 | 8/1991 | Schoch | 36/117 |
| 5,065,482 | 11/1991 | Lofy | 24/712.1 |
| 5,065,532 | 11/1991 | Gorza | 36/117 |
| 5,065,533 | 11/1991 | Paris | 36/117 |
| 5,148,614 | 9/1992 | Kelly | 36/50.1 |
| 5,152,038 | 10/1992 | Schoch | 24/68 SK |
| 5,158,559 | 10/1992 | Pozzobon et al. | 36/119 |
| 5,230,171 | 7/1993 | Cardaropoli | 36/50.1 |
| 5,325,613 | 7/1994 | Sussmann | 36/50.1 |
| 5,371,957 | 12/1994 | Gaudio | 36/50.1 |

*Primary Examiner*—Peter M. Cuomo
*Assistant Examiner*—Robert J. Sandy
*Attorney, Agent, or Firm*—Parkhurst, Wendel & Burr, L.L.P.

[57] ABSTRACT

An adjustable fastening system is disclosed for cinching together first and second opposing cinching members, interconnected via a closed-loop cable assembly, or a cable assembly including a discrete-length cable. The cable assembly is cooperable with an anchoring member which maintains the cable assembly in a tensioned state, thereby cinching the first and second cinching members together. The anchoring member includes at least one groove for receiving the cable assembly.

32 Claims, 18 Drawing Sheets

CABLE FASTENER

FIELD OF THE INVENTION

This invention relates to a simple to use, lightweight, inexpensive and reliable fastening system for a wide variety of securing operations including use in sport or leisure footwear. More particularly, the present invention relates to a cable fastening system comprising a cable that bends at a receiving guide member located on first or second cinching member, and an anchoring member having a groove receivingly releasing the tensioned cable to provide a simple and reliable fastening system. The anchoring member also retains the cable in place.

BACKGROUND OF THE INVENTION

Known cable fastener arrangements particularly for articles of footwear for example, have been employed with limited success and it remains in the art to provide a simple, lightweight, inexpensive and easily manipulated multipurpose cable fastening system. Fastening systems typically used for athletic footwear consist of a shoelace and a series of eyelets or holes on opposite sides of the instep. As is well known, the wearer dons the footwear typically by loosening the lace with both hands a series of times until the upper of the shoe is loose enough to allow the shoe to be placed on the foot. To tighten the shoe, the wearer pulls on the lace with both hands a series of times and subsequently ties a knot near the working ends of the lace securing the shoe about the foot in an attempt to retain a tight fit. However, the tightness of the fit does not always remain constant as shoelaces subsequently loosen due to the length of the laces and the pressure of each lace section upon the wearer's foot eventually evening out.

Shoelaces can also become untied forcing a wearer to interrupt physical activities and retie them to prevent tripping or stumbling over the untied laces. To an athlete, tripping or stumbling may have serious consequences. More importantly, the athlete may fall causing potentially serious injury to himself or others. Even tied shoelaces can extend below the shoe's outsole causing the user to fall or stumble.

Overtightening of a shoelace can cause high pressure points in the instep area greatly impairing the circulation of blood due to the pressure of the lace exerting a large force across a small area. Additionally, physically challenged persons have difficulty utilizing shoes with shoelaces because it takes two able hands to tie the laces. Further, worn shoelaces are susceptible to breakage during the stress applied thereto in the tightening process, and while they are inexpensive to replace, they may break at inopportune times making the shoes unusable unless a spare shoelace is quickly accessible.

Loop and pile element fasteners, e.g. VELCRO, have been used on shoes in lieu of or in addition to shoelaces as part of shoe fastening systems. These fasteners consist of two strips of material which produce a relatively strong holding force when interlocked together. However, loop and pile fasteners have a disadvantage in that they attract dirt and grime onto their holding surfaces causing their strips to lose holding power. In addition, a loop and pile fastener can become caught or snagged by a surface, potentially unfastening and losing its tensioning power.

Traditionally, articles of footwear that employ cable fasteners consist of lever-operable systems comprising a tensioning lever which is pivoted to one part of the footwear and a tension loop which is attached to another part of the footwear and interengageable with the tensioning lever.

Known lever-operable fasteners of this kind are commonly utilized on skiing boots comprising a bearing bracket, which is riveted to one part of the boot. The tensioning lever is pivoted to the bearing bracket and has a plurality of recesses for receiving a tension loop, which is pivoted to another part of the boot. When the tension of the closed fastener is not sufficient, the tension loop must be inserted into a recess which is more remote from the pivotal axis of the tensioning lever. For this operation the fastener must be opened. During the subsequent closing operation the lever arm between the point of engagement of the tension loop and the pivotal axis of the tensioning lever will be larger so that a larger effort is required to close the fastener. It is desired to restrict the effort required to close the fastener on the one hand and to adjust the fastener within a wide range on the other hand. There remains a need for a means for holding the wearer's foot and cinching the upper about the wearer's foot that is simple in construction and which causes these two actions to occur by the manipulation of one element. The present invention accomplishes both objects simply, reliably and inexpensively.

U.S. Pat. No. 5,325,613 to Sussmann discloses a fastening system similar to the type used in ski boots that has been converted for use in a running shoe. The shoe has an instep shield, a central tightening lock, a steel wire or wire rope, and guide channels. The central tightening lock is designed to be rotatable with the wire or rope attached to a part thereof. Although this fastening system overcomes many of the problems associated with shoelaces, it tends to be costly to manufacture the central tightening lock and labor intensive to assemble its connecting structures with the shoe. Further, the amount of plastic used for the central tightening lock, the instep shield, and the guide channels increases the weight of the shoe, which may be particularly undesirable for an avid runner desiring a lightweight running shoe. Also, the tightening lock and other moving parts can be susceptible to contamination by dirt detrimentally affecting the performance of the fastening system.

Both U.S. Pat. No. 4,937,952 to Olivieri and U.S. Pat. No. 4,408,403 to Martin illustrate a fastening arrangement similar to the type used in ski boots, and disclose a continuous cable that consecutively weaves through opposing pulleys alternatively arranged on the ski boot and leads through a guide actuated by a rear mounted lever. Although these systems address many of the problems associated with cable mechanisms attempting to hold the wearer's foot and cinch the upper about the wearer's foot by the manipulation of one element, the disclosed fastening arrangements suffer from numerous disadvantages that the present invention overcomes. One such disadvantage is that the disclosed fastening arrangements apply an extremely inefficient anchoring force along a direction approximately 90° to the cinching direction of the tongue in relation to the upper. Such application of force is inefficient, and requires the user to exert a large and undue amount of effort in an attempt to secure the footwear. Further, the disclosed fastening arrangements are unduly complex, are expensive to manufacture, have questionable durability, utilize excessive manipulation elements, have limited application and do not permit independent adjustment of tension along a toe box region, a midfoot region, a heel region, and an ankle region thereof, to provide a personalized fit.

SUMMARY OF THE INVENTION

In view of the foregoing, it is a principal object of the present invention to achieve an improvement over cable type fasteners and lever-operable systems.

More specifically, it is an object of the invention to provide a cable fastening system which eliminates the aforementioned problems associated with freely suspended shoelaces, loop and pile fasteners or lever-operable systems.

Another object of the invention is to provide a cable fastening system with unsurpassed reliability and one which provides for quick and uncomplicated adjustment and readjustment.

It is yet another object of the invention to provide a durable, lightweight, inexpensive and simple to manufacture cable fastening system.

Another object of the invention is to provide a cable fastening system for which a physically challenged person may easily manipulate.

Still another object is to provide a cable fastening system which has unsurpassed reliability in preventing slippage or preventing the inadvertent unfastening thereof.

Another object of the cable fastener includes a pull-tab bridging member which complementarily mates with an anchoring member providing a secure locking system.

These and other objects are achieved by the present invention which, according to one aspect, provides an adjustable fastening system comprising (i) opposing first and second cinching members that are adapted to be cinched together, the first cinching member including first and second spaced apart guide members, and the second cinching member including an opposing guide member, (ii) an effective closed-loop cable assembly connecting the first and second cinching members together, the cable assembly including a cable sequentially routing through the first guide member, the opposing guide member and the second guide member, and (iii) anchor means including an anchoring member for anchoring the cable assembly in a tensioned state thereby cinching the first and second cinching members together, the anchoring member forming at least one groove for receiving the cable assembly.

As described above, the first aspect of the present invention provides a closed-loop adjustable fastening system according to a preferable form of the present invention. The cable may turn on the first and second guide members and extend along parallel paths toward the second cinching member, forming a closed-loop portion which is received by the anchoring member. Preferably, the cable assembly includes a bridging member formed along the closed-loop portion, the bridging member being adapted to clip into the at least one groove of the anchoring member. The anchoring member may have a plurality of juxtaposed grooves, the closed-loop portion of the cable assembly forming a working end which may be freely displaceable along the entire length of the anchoring member.

Further, the cable assembly may include a pull-tab which is directly secured to the cable, or integrated with the bridging member. Indeed, the bridging member may be eliminated in favor of a pull-tab which has a leading edge that securely seats in a groove of the anchoring member. Further, the fastening system according to the first aspect may include additional guide members provided between the first and second guide members, as well as additional intermediate guide members, provided that the cable consecutively loops through opposing guide members integrated with the opposing cinching members so as to provide a serpentine cable path.

According to a second aspect of the present invention, a fastening system is provided, comprising (i) first and second cinching members that are adapted to be cinched together, the second cinching member including a first guide member, (ii) a connector assembly connecting the first and second cinching members together, the connector assembly comprising a flexible discrete-length connector having first and second ends, the first end being secured to the first cinching member, and the connector routing through the first guide member of the second cinching member and returning to the first cinching member, and a seating member connected to the second end of the connector, and (iii) anchor means including an anchoring member for anchoring the connector assembly in a tensioned state thereby cinching the first and second cinching members together, the cinching member forming at least one groove for receiving the seating member of the connector assembly.

According to the second aspect of the present invention the connector assembly may include a flexible discrete-length connector embodied as a web of material, in the form of a strap. However, the second aspect preferably employs a cable forming a cable assembly, as in the first aspect. Additional guide members may be provided on the cinching members to form, for example, 2-turn and 3-turn configurations. The seating member preferably has an outer contour that has a shape complementary to an inner contour of a groove of the anchoring member. The anchoring member preferably includes a plurality of grooves, to provide improved adjustability of the fastening system. In addition, the anchoring member may include a through-passage traversing the plurality of grooves, the through-passage receiving a portion of the cable extending from the seating member.

According to a third aspect of the present invention, a cable fastening system is provided that comprises (i) first and second cinching members adapted to be cinched together, the first cinching member including two spaced apart guide members, (ii) a cable assembly including a discrete-length cable including first and second ends each fixedly secured to at least one of the first and second cinching members, the cable sequentially extending from and engaging the second cinching member, the two spaced apart guide members, and returning to and engaging the second cinching member, and a pull-tab attached to the cable along a portion of the cable extending between the two spaced apart guide members, for applying tension to the cable, and (iii) anchoring means including an anchoring member that opposes the two spaced apart members and forms a plurality of grooves each adapted to receive the cable assembly, wherein the pull-tab is operable over a length of the anchoring member to adjustably tension the cable.

According to the third aspect of the present invention, the cable assembly may include a bridging member, as described above with respect to the first aspect of the present invention. A pull-tab may be provided, directly secured to the cable or integrated with the bridging member. The bridging member may be eliminated in favor of a pull-tab that includes a leading edge securely seating in each of the plurality of grooves.

Additionally, according to the third aspect of the present invention, the cable may extend from the first and second guide members and terminate at the respective first and second ends which are secured directly to the second cinching member at positions opposing the first and second guide members, respectively.

According to all aspects of the present invention, the cable may be slidable through the guide members. Alternatively, the guide members may be formed by pulleys, the pulleys being rotatable in accordance with translation of the cable.

Preferably, the cable fastening system provides a purchase of at least 1:1, and preferably, greater than 1:1 (e.g., 2:1, 3:1 and greater). The cable may be comprised of a material from the group consisting of nylon, braided metallic cord, natural cord and elastic material. In addition, the cable is considered to have an effective length, as measured along extension of the cable from the anchoring member to an opposing guide member. A short effective length provides a relatively large spacing between the cinching members, while a long effective length provides a reduced spacing between the cinching members. In an unsecured position, the working end of the cable is freely movable between the anchoring member and the cable guides, to maximize displacement of the first and second cinching members with respect to each other. In contrast, in a secured position, the cable assembly is press-fit and clipped into a groove of the anchoring member thereby maintaining a constant effective length of the cable. Additionally, the at least one groove of the anchoring member may be formed by at least one respective locking protrusion, in which the pull-tab directly seats.

Further, the present invention provides a cable fastening system incorporating an article of footwear as previously described. Preferably, a plurality of cable fasteners are provided along the article of footwear, so as to provide personalized tensioning of the article of footwear at respective portions of the wearer's foot. Additionally, each cable fastener is oriented on the article of footwear such that the anchoring member applies a force to the cable along a direction substantially parallel to the tensioning direction of the guide members to increase the efficiency of the cable fastening system.

As described above, the cable fastening system may form a closed-loop, or may be a single strand of cable having a working first end and an anchored second end. A test was performed to compare the holding force of both the closed-loop and single strand cable systems. The results showed that the closed-loop cable system in the preferred embodiment may provide a superior holding force over single strand cable systems, and is therefore considered preferable.

The present cable fastening system is not only particularly well suited for integration with an article of footwear, but may also be incorporated with other activewear or sporting goods, including baseball mitts, gloves, wristbands, headgear, etc., or any other application requiring a fastening system. Furthermore, the cable fastening system may find quite of variety of other cinching applications, for example, cinching a prosthetic limb or medical truss, cinching electrical conduit together and cinching luggage, to name a few. In addition, the article of footwear may be embodied as an ice-skate, ski boot, bicycling footwear, hiking boot, running shoe eg., high-top or low-cut oxford type, or a sandal etc.

DETAILED DESCRIPTION OF THE PREFERRED EMBODIMENTS

Figures 1, 1A:
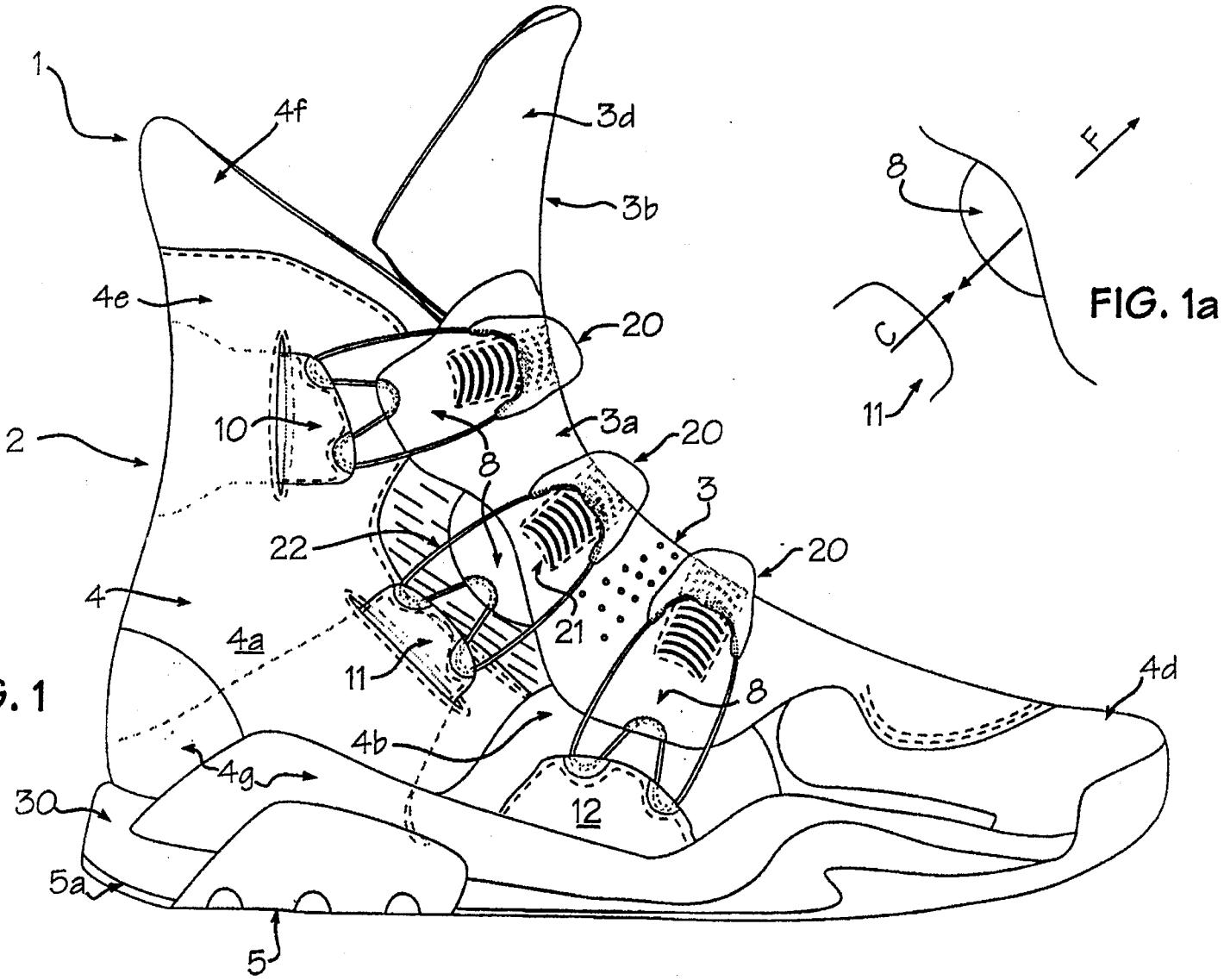
FIG. 1 is a lateral side elevational view of an article of footwear incorporating a first embodiment of the cable fastening system according to the present invention, in a closed position.
FIG. 1*a* is a schematic view of a relationship between cinching direction C and applied force F of the first embodiment of the present cable fastening system incorporated with the article of footwear in FIG. 1.

Referring now to the drawings, a description of preferred embodiments of the present invention is set forth. Same reference numerals are utilized among the different embodiments to denote similar structural features.

A preferred cable fastening arrangement of the present invention is disclosed in conjunction with articles of footwear as shown in FIGS. 1–7. Such articles of footwear and alternate embodiments of footwear intended to be integrated with the present cable fastening system are further defined in detail in commonly owned copending U.S. patent application Ser. No. 08/506,114, to assist in a complete understanding of the present invention. The disclosure of the '114 application is hereby incorporated by reference.

Article of footwear 1, in FIG. 1, comprises an upper 2 which includes tongue 3 and upper body 4. Tongue 3 includes a tongue overlay 3*a* and a tongue inner 3*b*. Inner surfaces of tongue overlay and tongue inner 3*a*, 3*b* may include padded closed cell foam, to provide added stability and comfort. Preferably, tongue inner 3*b* has a dorsal extension forming shin support 3*d* which aids in donning or removing the article of footwear, discussed below. Upper body 4 includes heel portion 4*a*, arch and instep portion 4*b* and toe portion 4*d* which respectively wrap around and receive the heel, arch and instep, and toes, respectively, of the foot of the wearer. Additional support is provided by ankle portion 4*e* which receives the ankle of the wearer. A sole 5 is connected to upper body 4 and is adapted for contacting a ground surface. In addition, a midsole 30 may be further provided between the outsole 5*a* and the upper 2.

Another preferable feature of the present article of footwear includes ankle and heel straps 10 and 11 that are freely slidable within the upper body 4, which affords the wearer personalized adjustability throughout the rearfoot of the upper body portion of the upper. Upper body 4 extends above ankle portion 4*e*, particularly padded collar 4*f* which reaches an apex along an aft portion of the upper body 4. Collar 4*f*, opposing portion of the tongue inner 3*b*, and shin support 3*d*, cooperate with each other to aid the wearer in donning or removing the article of footwear by providing additional gripping leverage for the wearer. These features are particularly preferable according to the present invention since the straps 10, 11 and 12 may be one-piece members, integrated with the tongue 3, that prevent tongue 3 from fully separating from medial and lateral sides of the upper body 4 (i.e., the integrated structure including tongue 3 and straps 10, 11 and 12 is only partially separable from the upper body 4, straps 10, 11 and 12 maintaining connection to medial and lateral sides of the upper body 4). Preferably ankle strap 10, heel strap 11, and arch and instep strap 12 each extend around the upper body and have opposite ends connected to tongue 3, particularly to tongue overlay 3*a* at flanges 8 along medial and lateral aspects thereof. Each of ankle strap 10 and heel strap 11 penetrates into the upper body and extends around a substantial portion of the upper body, between medial and lateral sides thereof. The arch and instep strap 12 extends between the upper 2 and the sole 5, arch and instep strap 12 having opposite ends each secured to tongue overlay 3*a* similar to ankle and heel straps 10 and 11. Arch and instep strap 12 is preferably freely slidable between the upper 2 and the sole 5.

Figure 2:
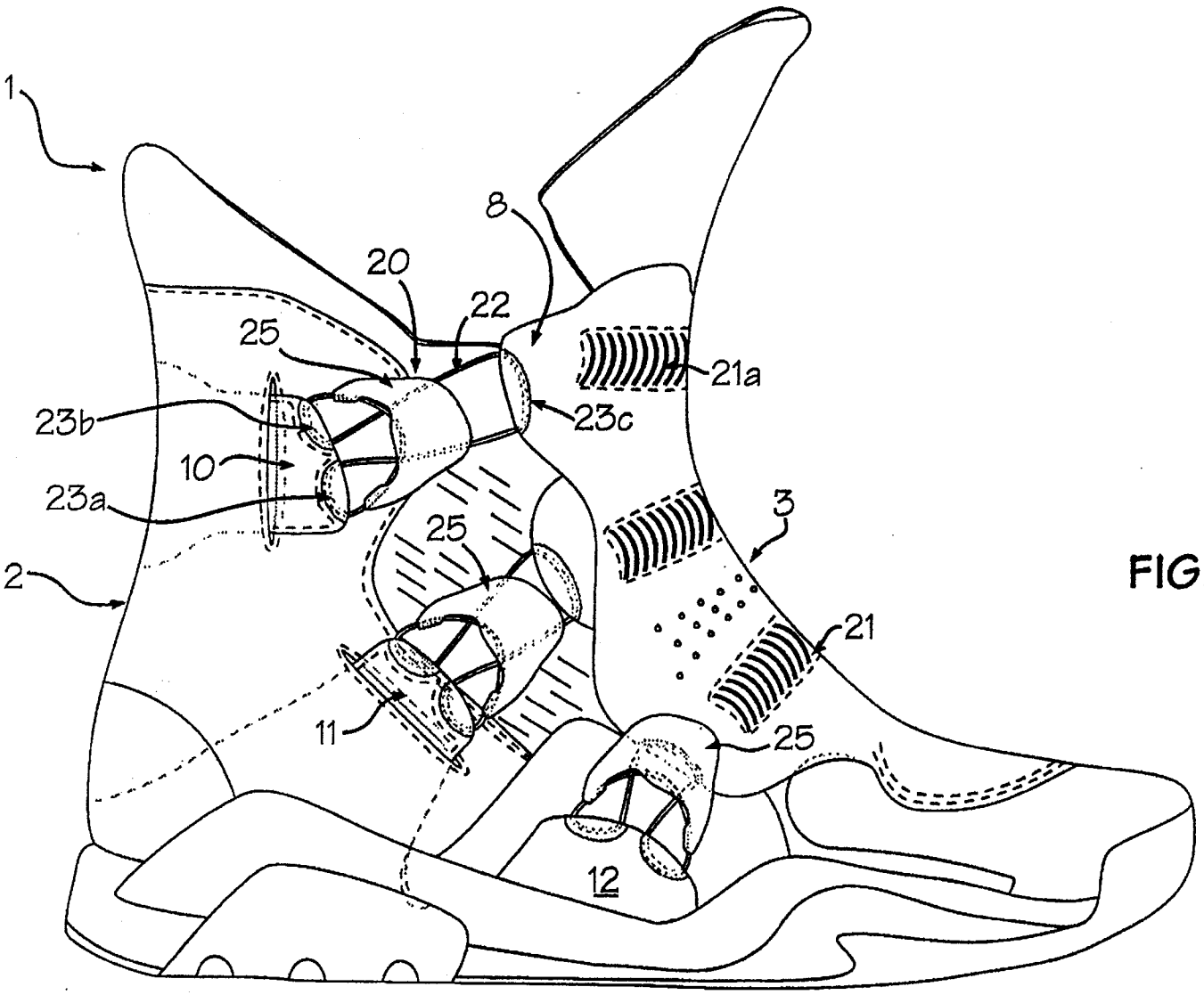
FIG. 2 is a lateral side elevational view of the article of footwear illustrated in FIG. 1, having released cinch devices.

The first embodiment of the cable fastener is disclosed in FIGS. 1–4. FIG. 1*a* defines in detail anchoring force F on cable 22 at anchoring member 21 exerted on strap 11 and flange 8 respectively forming first and second cinch members. Anchoring force F is substantially parallel to the cinching direction C. Application of anchoring force F in a direction substantially parallel to the cinching direction is particularly preferable, to maximize efficiency of cable fastener 20. Cable fasteners 20 in FIGS. 1–2, connect first and second opposite ends of each of straps 10–12, to opposing lateral sides of the tongue 3, particularly at flanges 8 extending laterally from tongue overlay 3*a*. Each of the cable fasteners includes an anchoring member 21 having a plurality of juxtaposed grooves 21*a* formed therein. It will be appreciated to those skilled in the art that the juxtaposed grooves and anchor members may or may not be contiguous. As shown in FIG. 2, cable fastener 20 includes a cable assembly formed by pull-tab 25 connected to cable 22. Cables 22 route through guide members 23*a–c* to form first, second and third turns on the ends of the straps and tongue overlay 3*a* at flanges 8 to form a complete closed-loop fastening system. The cables extend consecutively through first guide member 23*a*, opposing guide member 23*c* and second guide member 23*b* along a circuitous or serpentine path so as to form a closed-loop. Guide members may be made from any suitable material. In particular parts may be made completely or partially from metal especially light or powdered metal, compression cast alloy or from a suitable thermoplastic material that is preferably a polyamide e.g., nylon and would be preferably injection molded. Other materials and methods of manufacture may also be suitable and the present invention is not limited to any particular material or method of manufacture. In the preferred embodiment, the receiving annular groove of the guide members are shaped so as to conform directly to the annular surface of the cable as the cable is routed and freely turns about the inner annular surface of the guide. A further preferred embodiment of the guide members provide and permit the cable to clip-in to the inner annular groove surface of the guide to prevent accidental release of the cable thereby retaining an overall secure and reliable fastening system. In addition, the inner annular groove surface of the guide members are preferably formed similarly to anchoring member clip-in grooves 21*a* enabling the wearer to releasingly receive a replacement cable or a functional equivalent needed to perform in a specific athletic discipline. For example, cables of differing elastic properties may be appropriately chosen/replaced, or substantially non-stretchable cables (e.g., braided metallic cord) may be utilized. It will also be appreciated by those skilled in the art that the inner groove surface of the guide members may take the form of various cable shapes whether annular, L-shaped, V-shaped, etc.

To secure the present cable fastener in FIG. 2, with the article of footwear placed on the foot, the wearer tensions the article of footwear by pulling pull-tab 25 upwardly and medially thereby compressing tongue 3 against a dorsal (top) portion of the foot as the arch and instep strap 12 is simultaneously tensioned around the underside of the midfoot region. Straps 10–12 and tongue 3 provide a concentric tourniquet-like fitting effect as the cable fastening system is tensioned. When appropriate tension is achieved the wearer then press-fits the closed-loop portion of cable 22 into an appropriate groove 21*a* of anchoring member 21 and is clamped therein. To release the cable fastener, the wearer simply reverses the process. Pull-tab 25 is made, preferably, from a thermoplastic material, for example, a resilient polyester such as HYTREL from DuPont. Other suitable materials for pull-tab construction include natural cord webbing, synthetic cord or nylon webbing and low density polyurethanes or copolyesters. The first embodiment utilizing closed-loop cables 22 provides the wearer with an additional purchase or mechanical advantage ranging from 1:1 to 2:1 to assist in ease of tension adjustment of the present cable fastening system. As well understood by one of ordinary skill in the art of cinching mechanisms, particularly simple pulley-type or block and tackle mechanisms, cable fastener 20 at strap 11 shown in FIG. 1 has a purchase of 2:1 assuming displacement of strap 11, cable 22 being considered fixed at the apex of guide member 23*c* with respect to stationary tongue overlay 3*a*. Strap 11 may be considered displaceable with respect to tongue overlay 3*a* after being seated on the dorsal portion of the wearer's foot.

According to the article of footwear illustrated in FIGS. 1 and 2, anchoring members 21 may extend fully around an outer surface of the tongue overlay 3*a*, and the anchoring members 21 may be shared by opposing cable fasteners to allow for maximum tension adjustability. Clip-in groves 21*a* may be contiguously formed on an anchoring member or may be formed singly and attached to tongue overlay 3*a* using conventional stitch, adhesion, or molded techniques. Clip in grooves may comprise ratchet-like notches. Orientation of one or more of the cable fasteners may be reversed as illustrated in FIG. 5, at ankle strap 10, whereby, pull-tab 25 extends towards the respective strap, and the respective anchoring member 21 is provided on the opposite strap or upper body 4.

Figure 3:
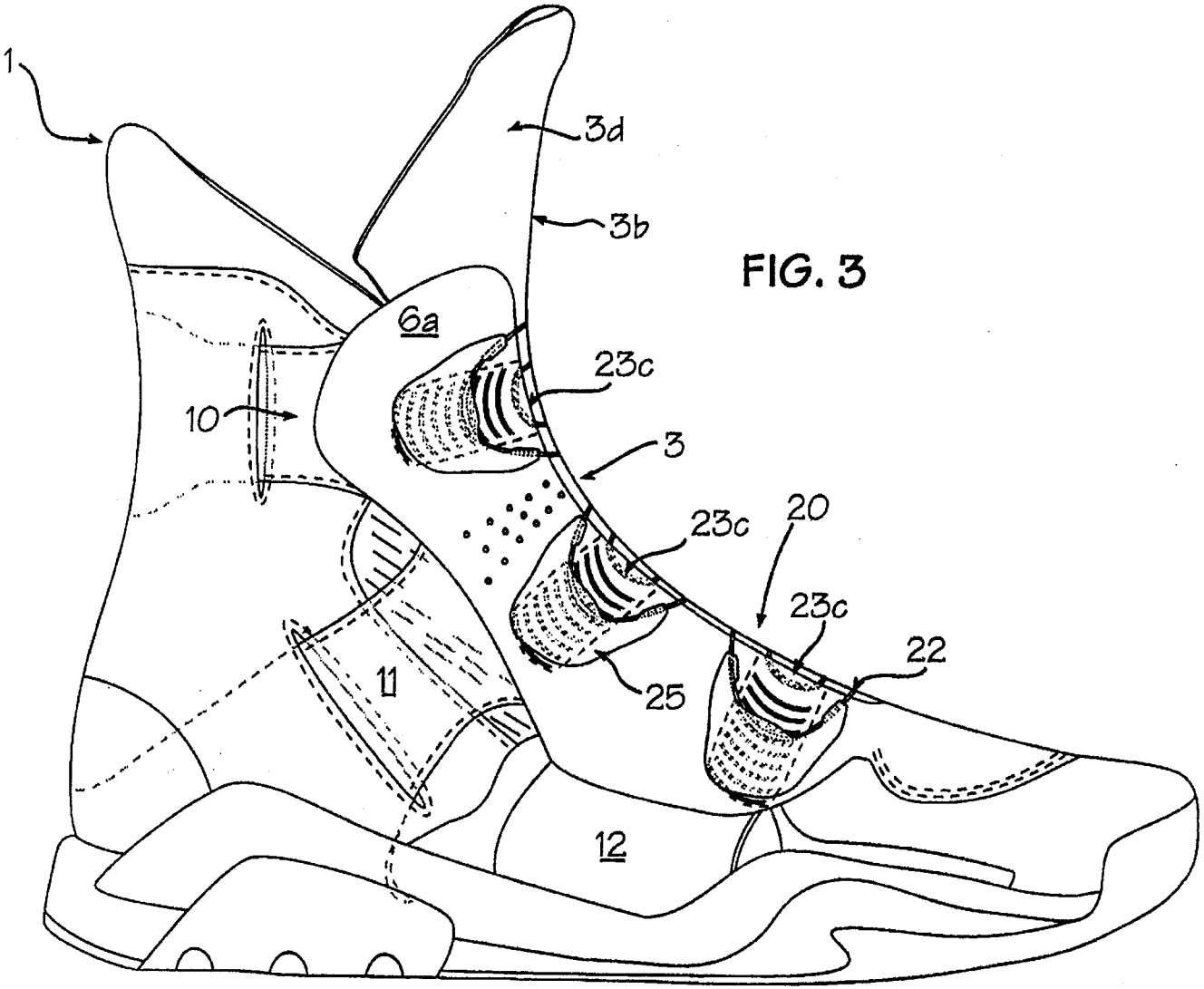
FIGS. 3 and 4 are lateral side elevational and medial side elevational views of an article of footwear incorporating a first embodiment of the cable fastening system according to the present invention, along a tongue member.
Figure 4:
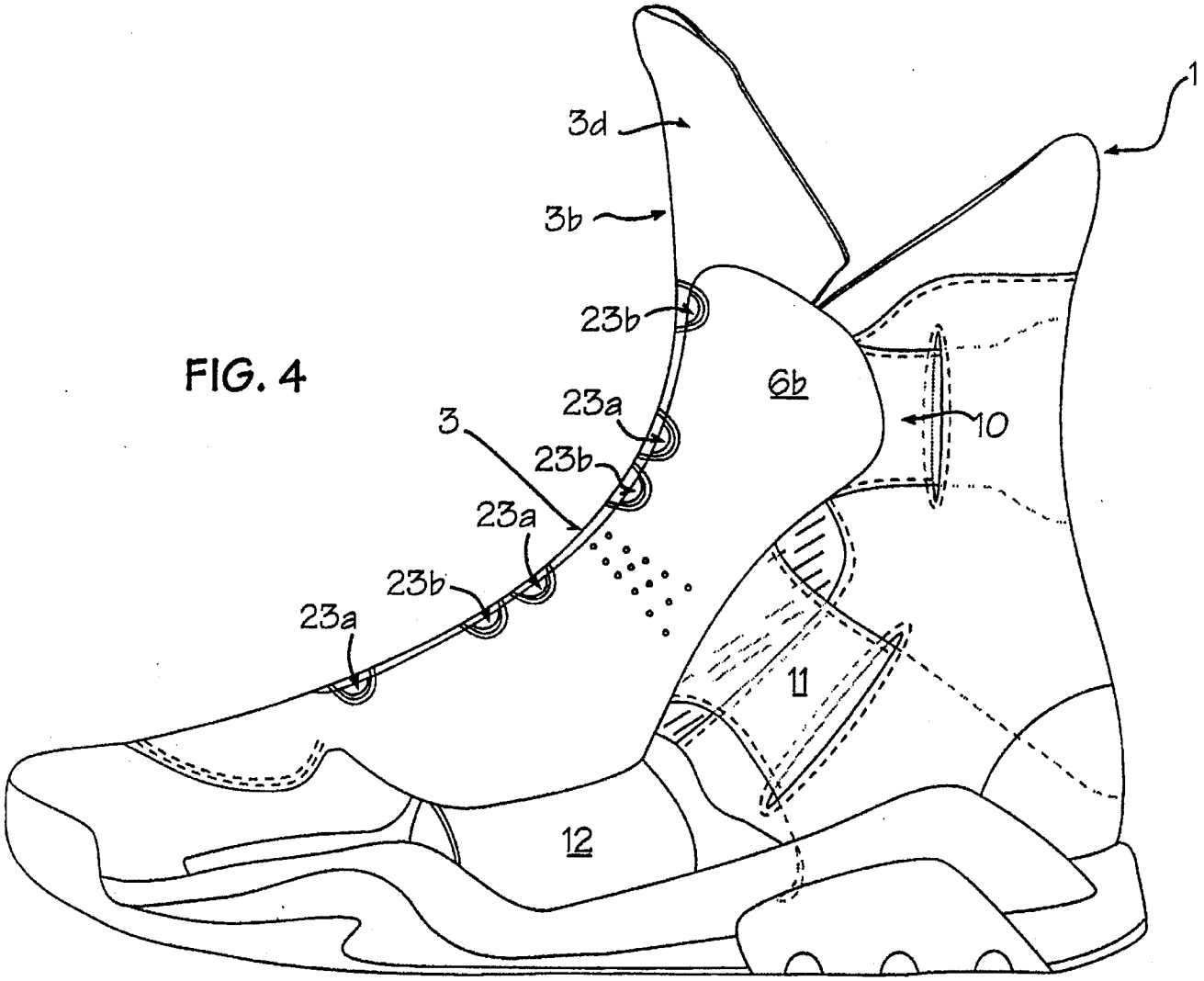

FIGS. 3 and 4 of the first embodiment illustrate a plurality of cable fasteners 20 spaced apart along the length of tongue 3 connecting bifurcated tongue flanges 6*a* and 6*b*. As similarly illustrated in FIGS. 1 and 2, FIGS. 3 and 4 provide cables 22 extending through guide members 23*a–c*, guide members 23*a* and 23*b* being spaced apart along one of tongue flange 6*a*, and opposing guide member 23*c* extending along the opposing tongue flange 6*b*. In addition, cable fasteners illustrated in FIGS. 3–4, may also be reversed, said tabs 25 extending medially or towards inside of the article of footwear.

Figure 5:
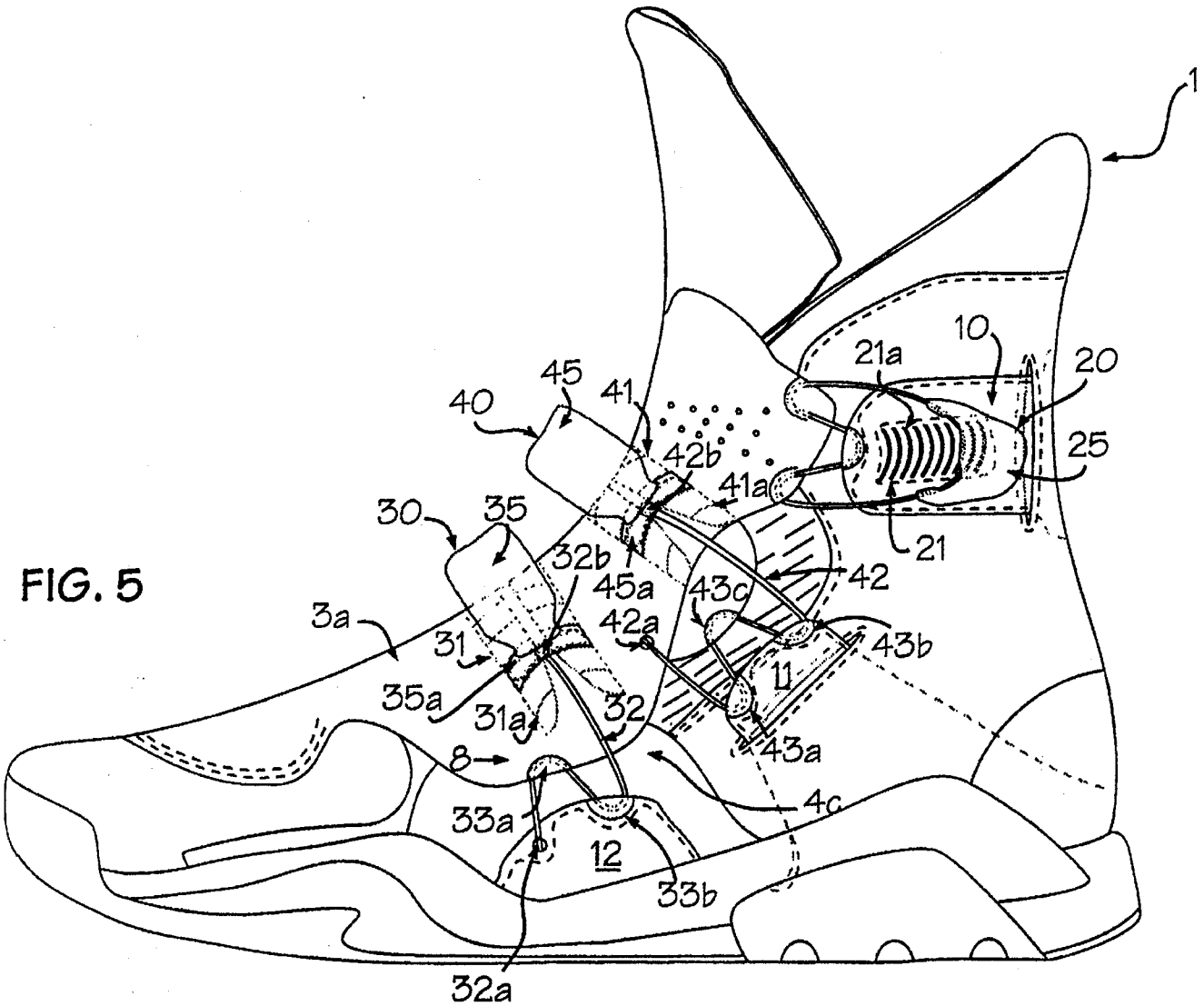
FIG. 5 is a medial side elevational view of an article of footwear incorporating first, second and third embodiments of the cable fastening system according to the present invention.

Article of footwear 1 in FIG. 5, illustrates present cable fastener 20 previously described in conjunction with FIGS. 1–4 above, with second and third additional embodiments 30 and 40. A second embodiment of the present cable fastening system, cable fastener 30, utilizes a cable assembly including cable 32 having first end 32*a* and second end 32*b*, and a pull-tab assembly including pull-tab 35 and seating member 35*a*. First end 32*a* is attached to arch and instep strap 12 and consecutively extends therefrom through guide members 33*a* and 33*b* formed on tongue overlay 3*a* and arch instep strap 12, respectively. Second end 32*b* of cable 32 is secured to the pull-tab assembly formed by pull-tab 35 and seating member 35*a*. Preferably, the seating member has an outer contour that is complementary in shape to an inner contour of the grooves 31*a* of the anchoring member 31, such that the seating member 35*a* may be releasingly received in any of grooves 31*a*. The purchase of cable fastener 30 is approximately 2:1.

A third embodiment of the present cable fastening system illustrated in FIG. 5 comprises cable fastener 40 which utilizes a cable assembly including cable 42 and pull-tab assembly. Cable 42 has discrete ends, particularly, first end 42*a* and second end 42*b*. First end 42*a* is attached to tongue overlay 3*a*. Cable 42 consecutively extends through first guide member 43*a*, opposing guide member 43*c*, and second guide member 43*b*. First and second guide members 43*a* and 43*b* are spaced apart along heel cinch member 11 and opposing guide member 43*c* is positioned on flange 8 of tongue overlay 3*a*. Second end 42*b* is secured to the pull-tab assembly including pull-tab 45 and seating member 45*a* may be releasingly received in any of grooves 41*a* of anchor member 41. The purchase of cable fastener 40 is approximately 3:1.

In each of the second and third embodiments illustrated in FIG. 5, anchoring members 31, 41 advantageously include a through-passage traversing the grooves 31*a*, 41*a*, to allow free passage of the cable extending from the seating members 35*a* and 45*a*.

In addition, FIG. 5 illustrates present cable fastening systems with varying purchases of approximately 1:1, 2:1 and 3:1. By specifically tailoring the purchase of the present cable fastening system in conjunction with an article of footwear, the wearer will gain greater tensioning advantages at different or independent locations along the footwear upper. These advantages are a result of the holding force supplied by anchoring members 21, 31 and 41 extending along a direction substantially parallel to the cinching direction of the tongue overlay 3*a* with respect to the upper body 4, illustrated in FIG. 1*a*.

Figure 6:
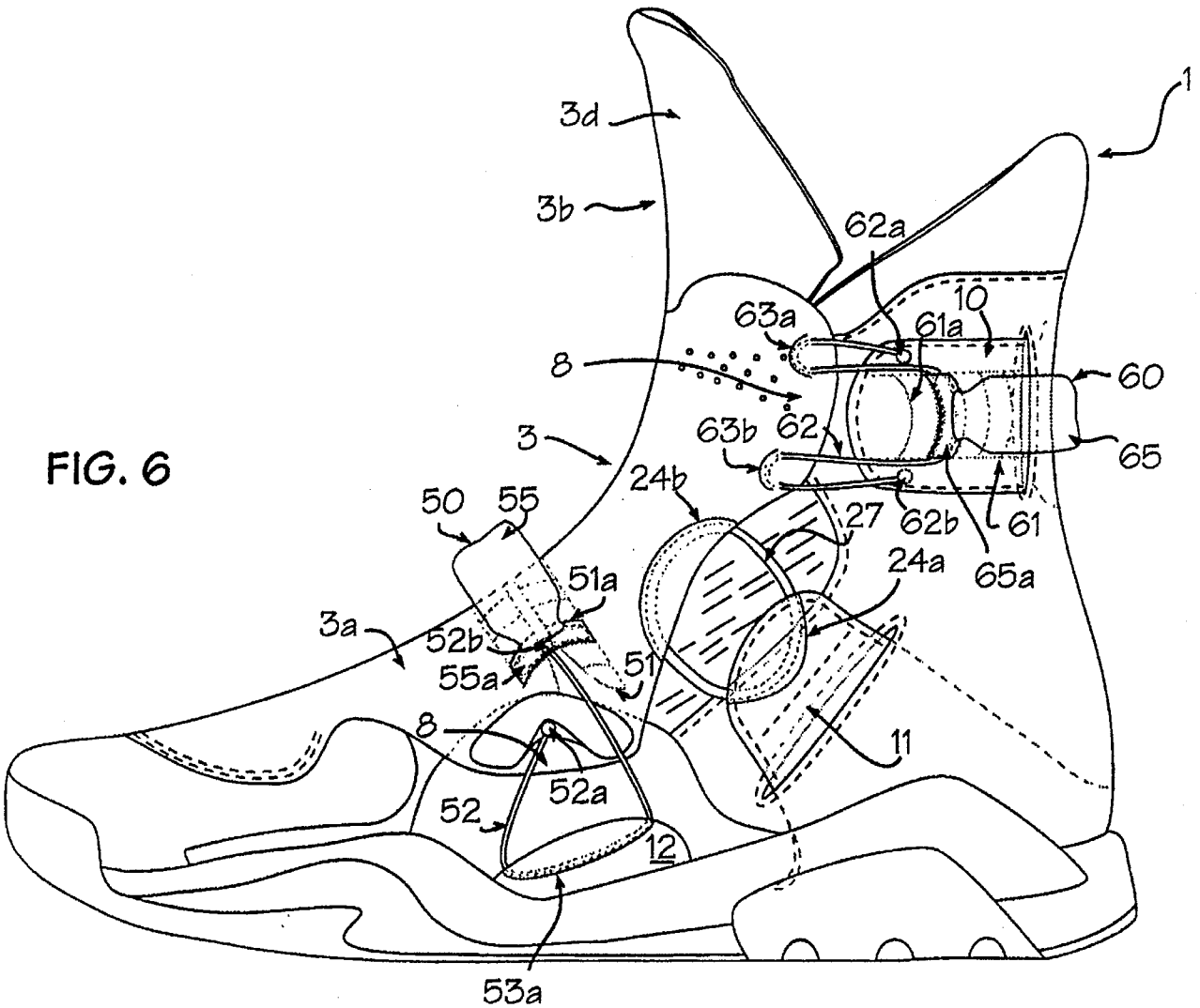
FIG. 6 is a medial side elevational view of an article of footwear incorporating fourth and fifth embodiments of the present cable fastening system according to the present invention.

Incorporated into article of footwear 1 of FIG. 6, are closed-loop elastomer member 27 integrated with connecting heel cinch member 11 to tongue overlay 3*a* and fourth and fifth embodiments of the present cable fastening system. Cable fastener 50 of the fourth embodiment utilizes a cable assembly including cable 52 and pull-tab assembly. Cable 52 has first end 52*a* and second end 52*b*. First end 52*a* is attached to tongue overlay 3*a* at flange 8, and extends through single guide member 53*a* formed on arch and instep cinch member 12. Cable 52 returns to tongue overlay 3*a* and terminates at the second end 52*b* secured to the pull-tab assembly including pull-tab 55 and seating member 55*a*. Similar to tabs 25, 35 and 45, pull-tab 55 of cable fastener 50 provides seating member 55*a* which is releasingly received in any one of grooves 51*a* of anchoring member 51. The purchase of cable fastener 50 is approximately 2:1, determined by tensioning arch and instep cinch member 12 against displaceable tongue overlay 3*a*. As in the second and third embodiments shown in FIG. 6, a through passage extends along anchoring member 51 for passage of cable 52.

In each of the second, third and fourth embodiments illustrated in FIGS. 5 and 6, although the cable is a preferable form of the connector interconnecting the cinching members (i.e., tongue overlay and opposing straps), the cable may be replaced by other flexible connectors, such as webbing in the form of an elongated strap member. In such a case, the guide members may be formed as loops secured to the straps 10, 11 and 12 and/or flanges 8. The strap member extends through the opening of each such loop and turns back upon itself, thereby extending back to the opposing strap or flange and seats in an anchoring member on upper 2 or tongue 3. In addition, a pull tab may be formed by an extension of the material adjacent the seating member, thereby providing a loose or free end that may be easily grasped by the user.

FIG. 6 also illustrates a fifth embodiment of the present invention comprising cable fastener 60. Similar to tabs 35, 45, and 55, pull-tab 65 of cable fastener 60 provides seating member 65*a* which is releasingly received in any one of grooves 61*a* of anchoring member 61. Cable 62 extends through guide members 63*a* and 63*b* formed on tongue overlay 3*a* and terminates on the ankle strap 10 at ends 62*a–b*. The purchase of cable fastener 60 is approximately 2:1, determined by tensioning ankle strap 10 against displaceable tongue overlay 3*a*. Orientation of cable fastener 60 may be reversed at ankle strap 10, whereby, pull-tab 65 extends away from the ankle strap 10, and the anchoring member 61 is provided on tongue overlay 3*a*.

Figure 7:
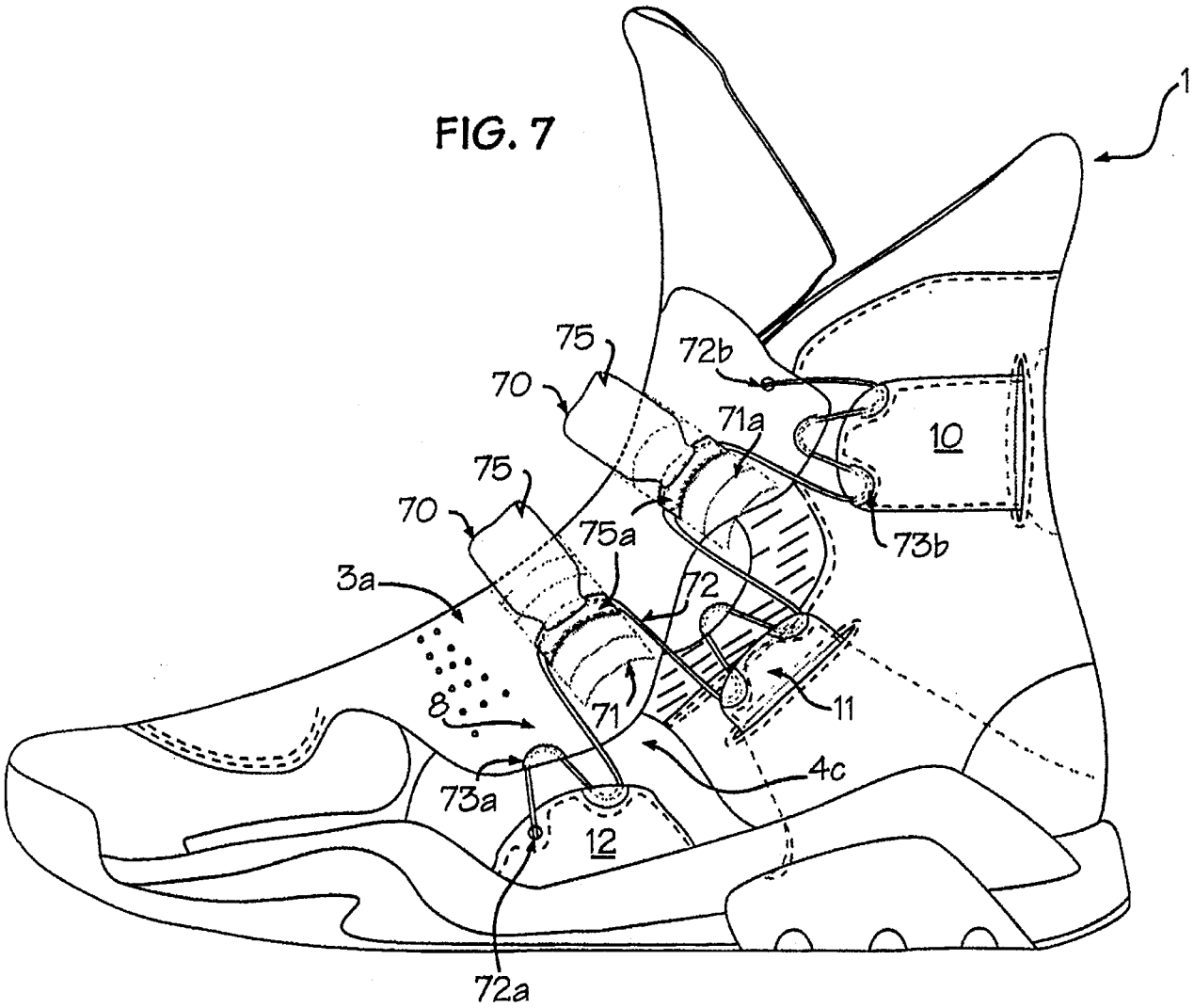
FIG. 7 is a medial side elevational view of an article of footwear incorporating a sixth embodiment of the cable fastening system according to the present invention.

A sixth embodiment of the present cable fastening system illustrated in FIG. 7 comprises integrated cable fasteners 70, conjoined via single cable 72 having first and second ends 72*a* and 72*b* respectively securely fixed to strap 12 and the tongue overlay 3*a*. The ends may also be both fixed to the tongue overlay, or both to the straps 12 and 10, respectively. Cable 72 alternately extends through guide members 73*a* formed along tongue overlay 3*a* and guide members 73*b* formed along the upper body at respective straps 10, 11 and 12. Here, the straps 10, 11 and 12 are collectively considered a first cinching member, while tongue overlay 3*a* forms the second anchoring member. Each of cable fasteners 70 includes pull-tab 75 having bridging member 75*a* through which cable 72 extends or may be fixed. Bridging member 75*a* may be releasingly received in any of grooves 71*a* of anchoring member 71. The purchase advantage to be gained by the wearer of article of footwear 1 between arch and instep strap 12 and the tongue overlay 3*a* is approximately 2:1, approximately 3:1 between heel strap 11 and tongue overlay 3*a*, and approximately 3:1 between ankle strap 10 and tongue overlay 3*a*. As similarly illustrated in FIG. 5, article of footwear 1 in FIG. 7 provides an added feature of locating cinch devices 70 along independently respective areas of the upper to derive various mechanical advantages. In this embodiment, the purchase varies from 2:1 at the toe portion or toe box of the upper to 3:1 at the midfoot and rearward towards the ankle portion of the upper.

It should be understood by one skilled in the art that the independently adjustable cable fasteners disclosed in FIGS. 1–7 allow application of relatively light pressure around the toe box of the upper, while gradually increasing pressure through the midfoot and ankle portion thereby allowing the wearer to precisely dial-in the desired fit along the entire length of the upper and over a broad surface area. The present invention also allows the wearer to adjust independently the amount of pressure applied to the midfoot and heel portion of the upper, a feature that is critical to increased footwear stability. To operate the present cable fastening system in FIG. 7, the wearer may simply don the article of footwear by releasing respective pull-tabs allowing for the footwear to be placed on the wearer's foot. The wearer may then engage all tabs with the respective anchoring members to gain a mechanical advantage from each of the cable fasteners. At this point, the wearer may now dial-in the amount of tension applied to the desired areas of the foot, by choosing an appropriate groove of an anchoring member that releasingly receives the cable. In addition, various tension adjustments may be applied to one side of the foot or the other (i.e., medial and lateral aspects of the foot) dependent upon the amount of force the wearer applies to a specific pull-tab.

Figure 8:
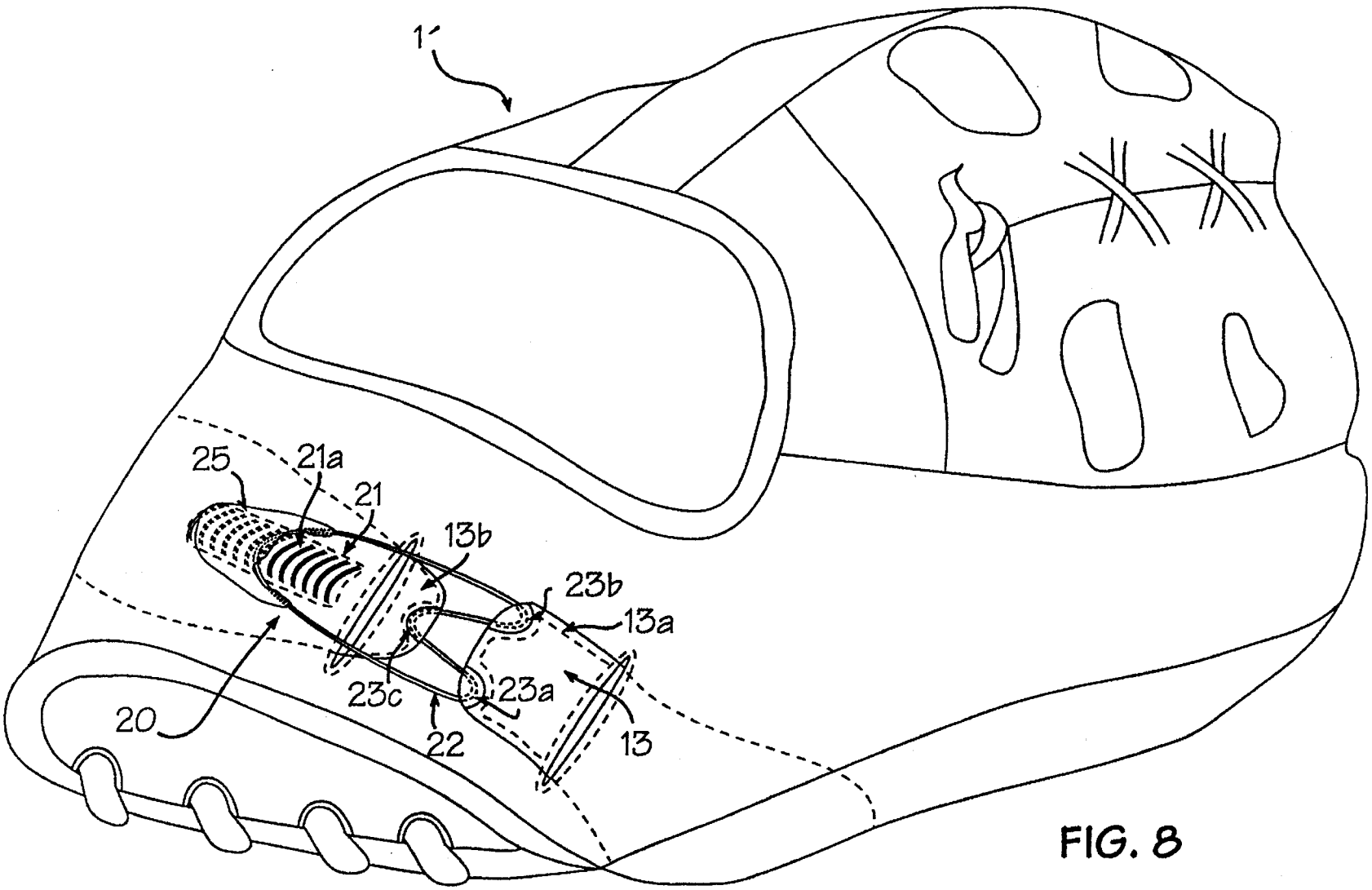
FIG. 8 is an elevational perspective view of a baseball mitt integrating the first embodiment of the cable fastening system according to the present invention.

FIG. 8 discloses an alternate application of the first embodiment of the present cable fastener to various sporting goods, namely, baseball mitt 1'. Cable fastener 20 comprises strap 13 having opposing ends 13*a* and 13*b*, forming first and second cinching members. The cable fastener 20 is adapted to fasten and bring together the spaced apart strap ends to tighten the backhand portion of the glove around the wrist of a wearer. In this embodiment, cable 22 connects opposing ends 13*a* and 13*b* of strap 13. Anchoring member 21 having juxtaposed grooves 21*a* is provided on an outer surface of mitt 1'. Orientation of cable fastener 20 may be reversed, as illustrated in FIG. 5 at ankle strap 10, and pull-tab 25 may extend toward the opposite end. The mechanical advantage of cable fastener 20 ranges from 1:1 to 2:1, and the tension applied to ends 13*a–b* may be varied over a wide range by appropriately seating cable 22 in desired groove 21*a*.

Figure 10:
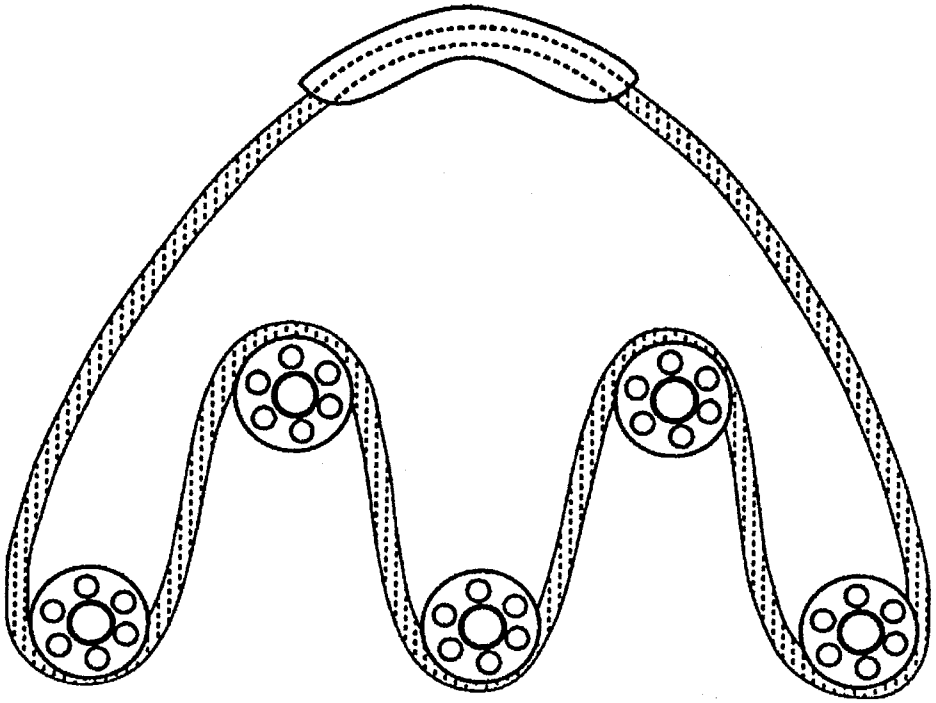
FIGS. 9 and 10 are schematic views of alternative embodiments of the cable fastening system according to the present invention.
Figure 9:
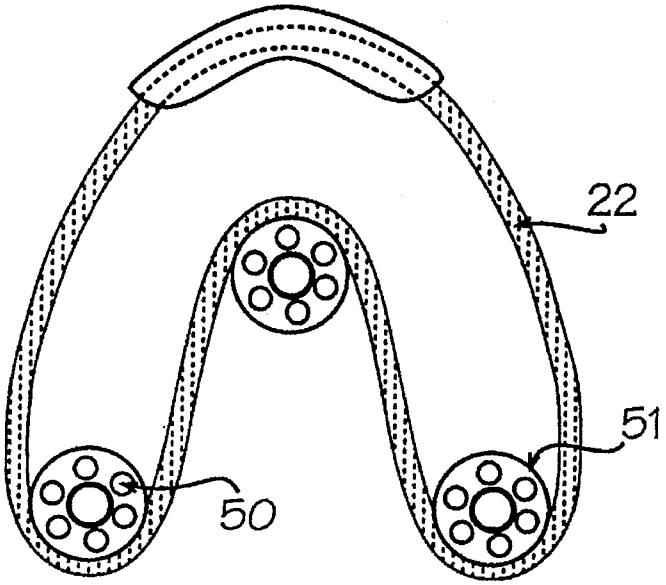

Two additional embodiments of the present invention, similar to cable fastener 20 described earlier, are illustrated in FIGS. 9–10. Both embodiments disclose cable fastening systems wherein cable 22 extends around synthetic or alloy roller bearings 50 which replace the first, second and opposite guide members 23*a–c* illustrated above. Pulley 51 is preferably made from an injection molded synthetic plastics material or thermoplastic such as NYLON GLASS FIBER, available from LNP Engineering Plastics. Cable 22 may be formed of nylon, elastic, or braided metallic cord, natural cord or a combination thereof. The purchase of the cable fastener in FIG. 9 ranges from 1:1 to 2:1 and approximately 2:1 in FIG. 10, but may be modified to 3:1 and higher to derive an even greater mechanical advantage from the cable fastening system.

Figure 11A:
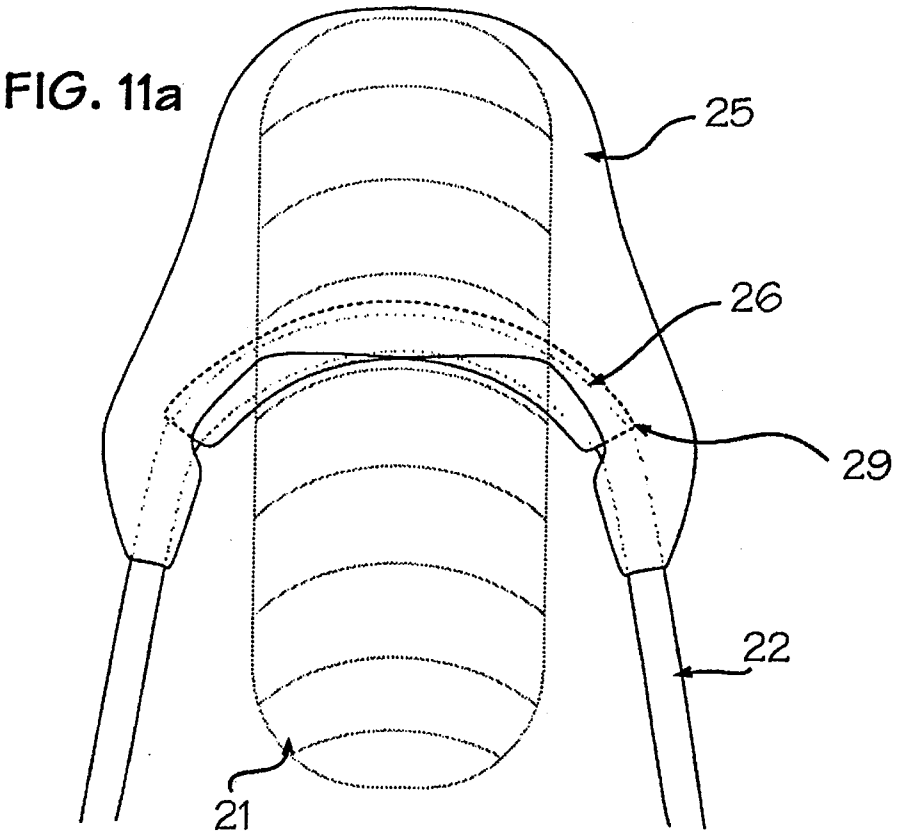
FIGS. 11*a* and 11*b* are partial top and side views, respectively, of connecting structures of the cable fastening system according to an alternate embodiment of the present invention.
Figure 11B:
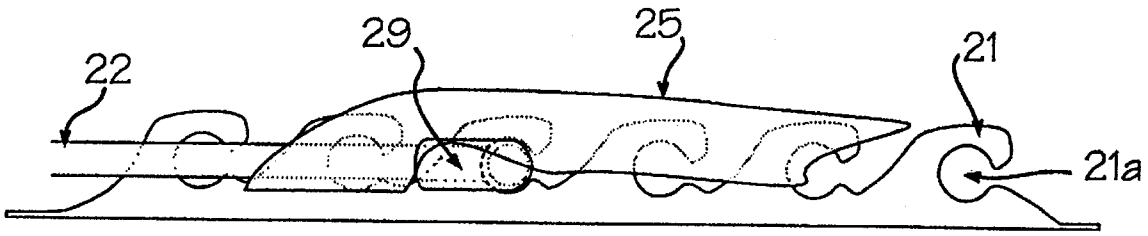

FIGS. 11*a* and 11*b* illustrate enlarged views of anchoring member 21, clip-in grooves 21*a*, and cable assembly including cable 22 and pull-tab 25 of the first embodiment of the present invention. Pull-tab 25 comprises an outer peripheral edge which bounds sides of the anchoring member 21. Cable 22 forms closed-loop portion 26, encircled by bridging member 29. Bridging member 29 may be made from a thermoplastic material, and may be sufficiently rigid to provide a secure snap-in locking function in clip-in grooves 21*a*. Clip-in grooves 21*a* are shaped so as to permit the bridging member 29 to clip therein, as detailed in FIG. 11*b*.

Figures 12A, 12B:
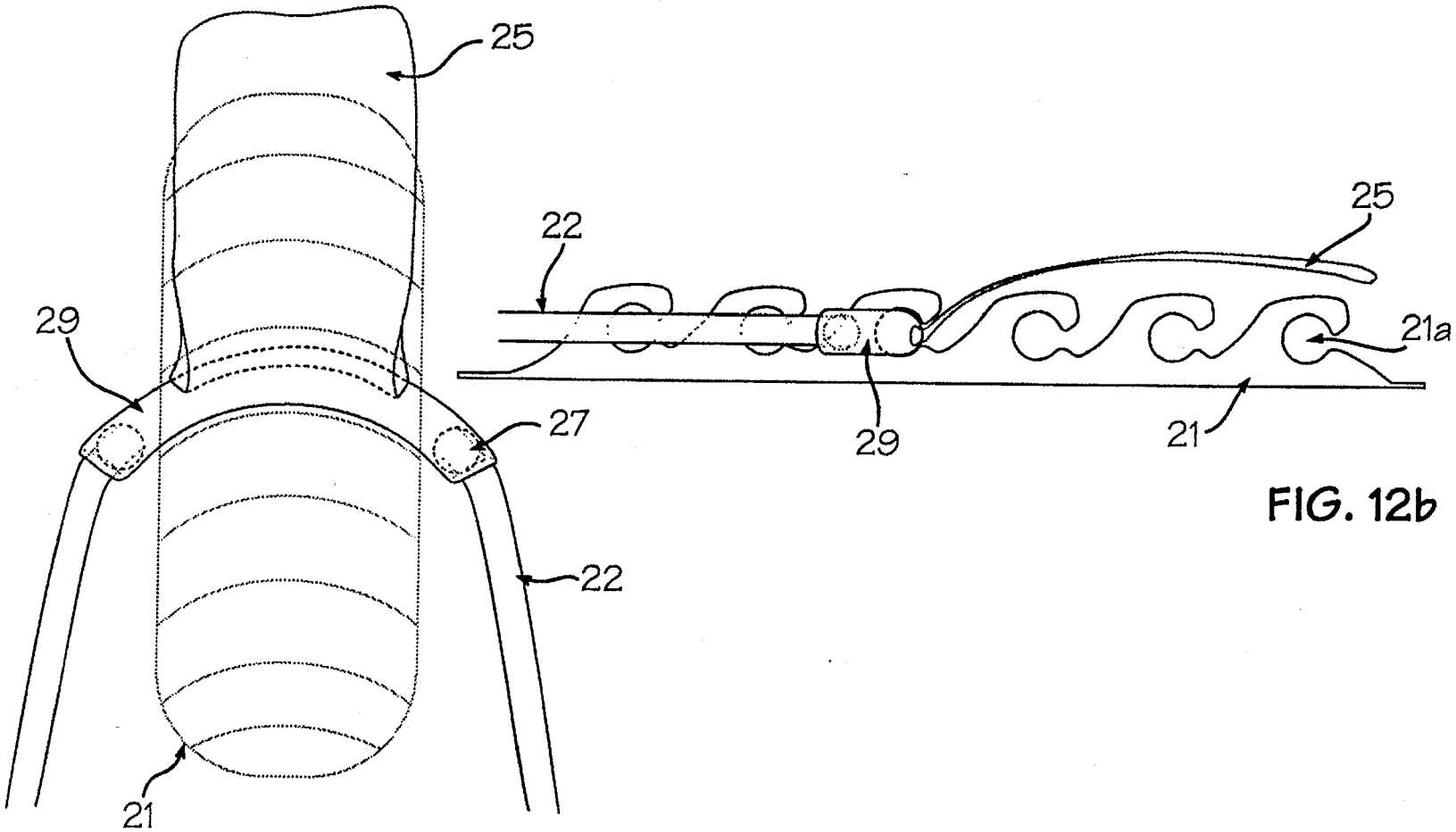
FIGS. 12*a* and 12*b* are partial top and side views, respectively, of connecting structures of the cable fastening system according to an alternate embodiment of the present invention.

Particular variations on the embodiment illustrated in FIGS. 11*a* and 11*b* include those disclosed in FIGS. 12*a–*18*b*. Referring to FIGS. 12*a–b*, cable 22 effectively forms a closed-loop and is attached to opposite sides of bridging member 29 via terminals 27 seated therein. Terminals 27 may be formed by a ball or plug member secured to ends of the cable 22, or may be formed as a crimp/splicing sleeve, commonly marketed under the trade name NICO-PRESS. Cable 22 may be knotted-off at opposite sides of bridging member 29. Pull-tab 25 is connected directly to the bridging member 29. It is preferred in all bridging member and clip-in groove embodiments that bridging member 29 includes an outer diameter sized to clip into grooves 21*a*.

Figure 13B:
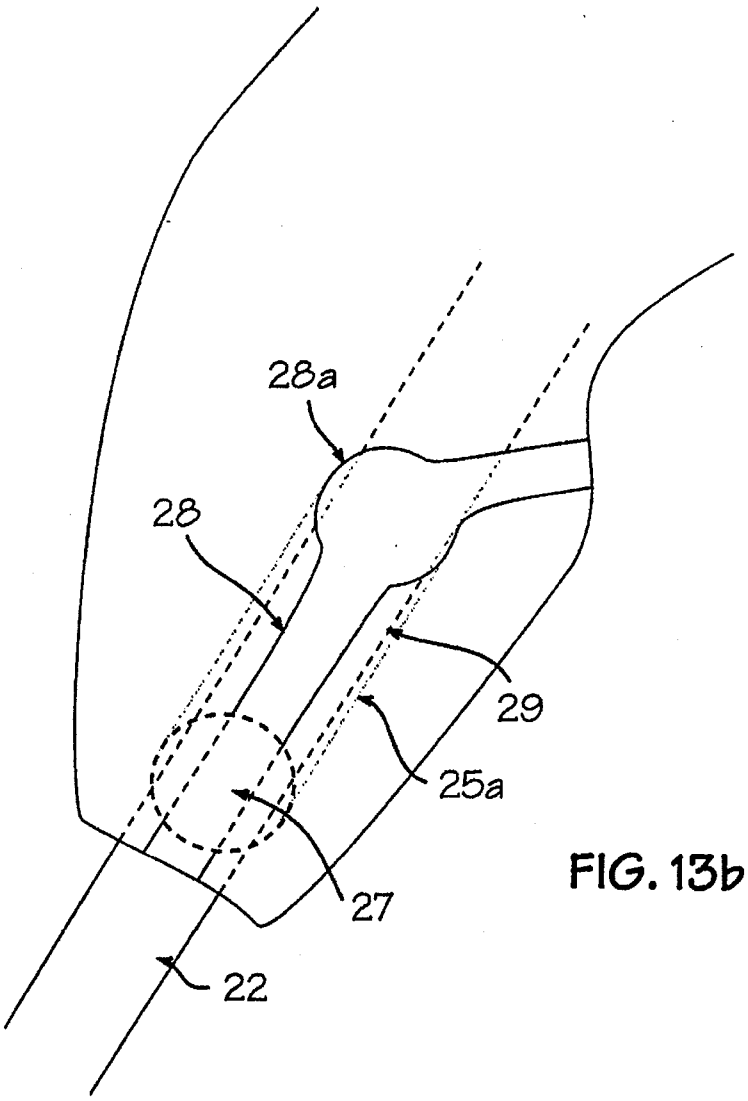
FIGS. 13*a* and 13*b* are partial top and enlarged perspective interior side views, respectively, of connecting structures of the cable fastening system according to an alternate embodiment of the present invention.
Figure 13A:
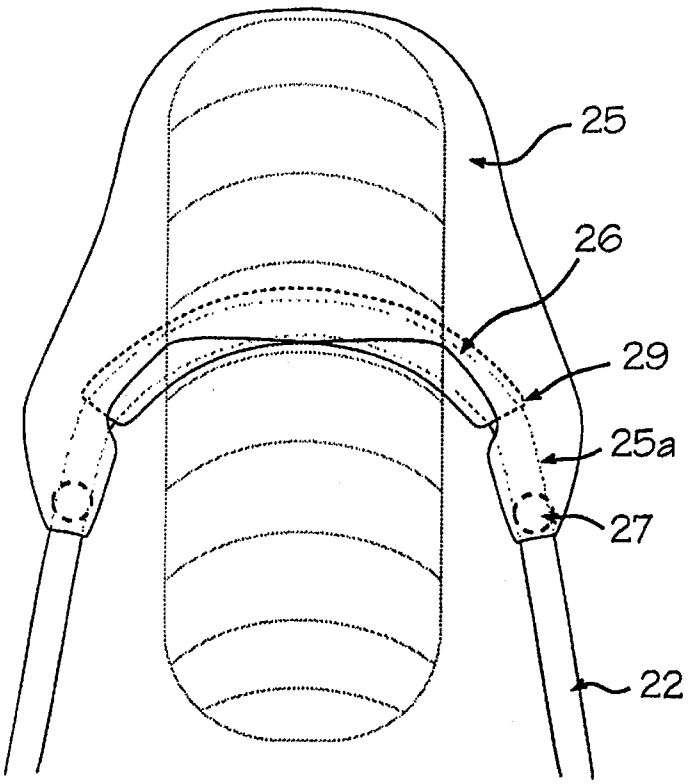

FIGS. 13*a* and 13*b* disclose cable 22 forming a closed-loop portion 26 having bridging member 29 formed thereon. Cable 22 further provides terminals 27 seated within groove 25*a*. Terminals 27 prevent pull-tab 25 from riding along cable 22. FIG. 13*b* further illustrates a cable replacement feature wherein cable 22 may be released from pull-tab 25 by terminals 27 through enlarged portion 28*a* of open channel 28.

Figure 14A:
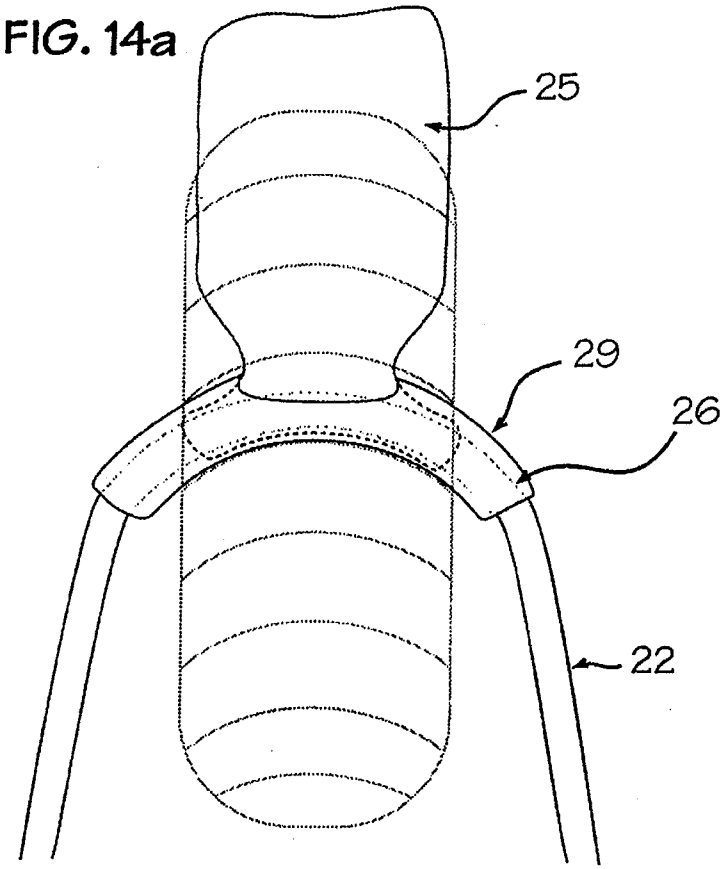
FIGS. 14*a* and 14*b* are partial top and side views, respectively, of connecting structures of the cable fastening system according to an alternate embodiment of the present invention.
Figure 14B:
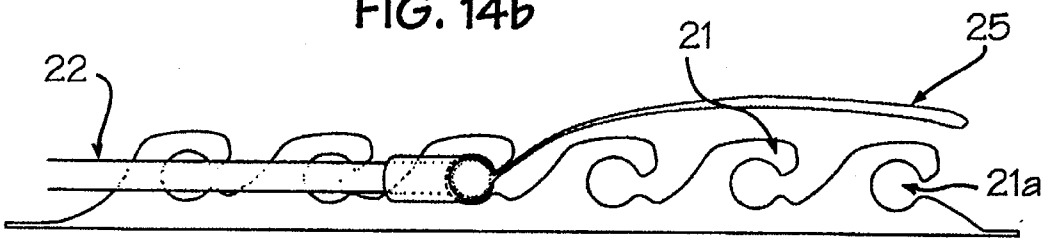

FIGS. 14*a* and 14*b* illustrate another variation on cable fastener 20 and pull-tab 25 construction. Again, cable 22 forms a closed loop 26, extending through bridging member 29, which may be formed of thermoplastic material, and pull-tab 25.

Figure 15A:
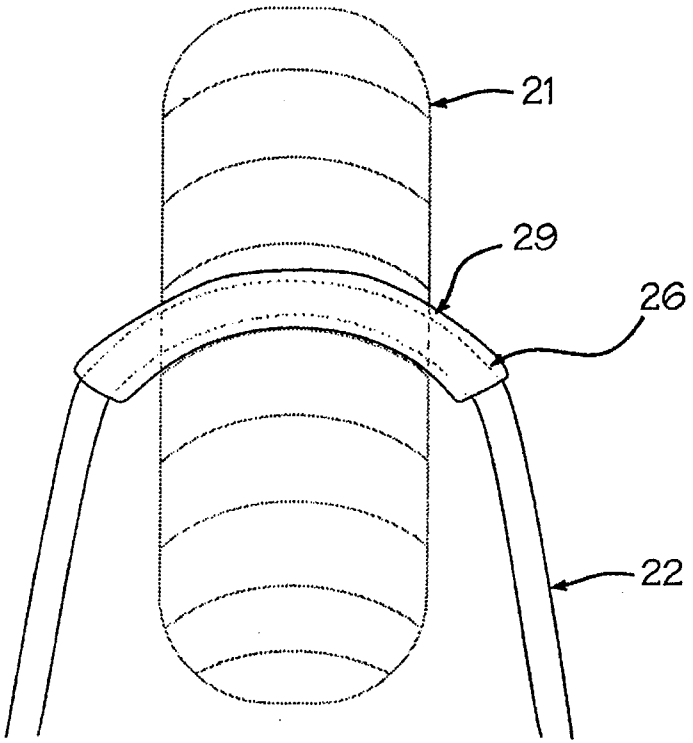
FIGS. 15*a* and 15*b* are partial top and side views, respectively, of connecting structures of the cable fastening system according to an alternate embodiment of the present invention.
Figure 15B:
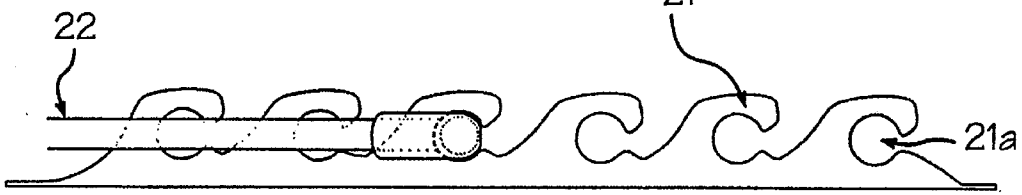

FIGS. 15*a* and 15*b* illustrate a simplified and economical variation on the construction of FIGS. 11*a* and 11*b*. Here, the pull-tab is eliminated thereby leaving bridging member 29 to seat in clip-in grooves 21*a*. Although the pull-tab is eliminated, tensioning or release of the cable 22 may be easily carried out by grasping and pulling cable 22 directly. The particular variation in FIG. 15*a* may be desirable to ensure against accidental release of the cable 22 from the anchoring member 21, via unintended forceful contact with the pull-tab, such as in a contact sport. Although the cable assembly includes cable 22 and bridging member 29, it may be formed by cable 22 alone.

Figure 16A:
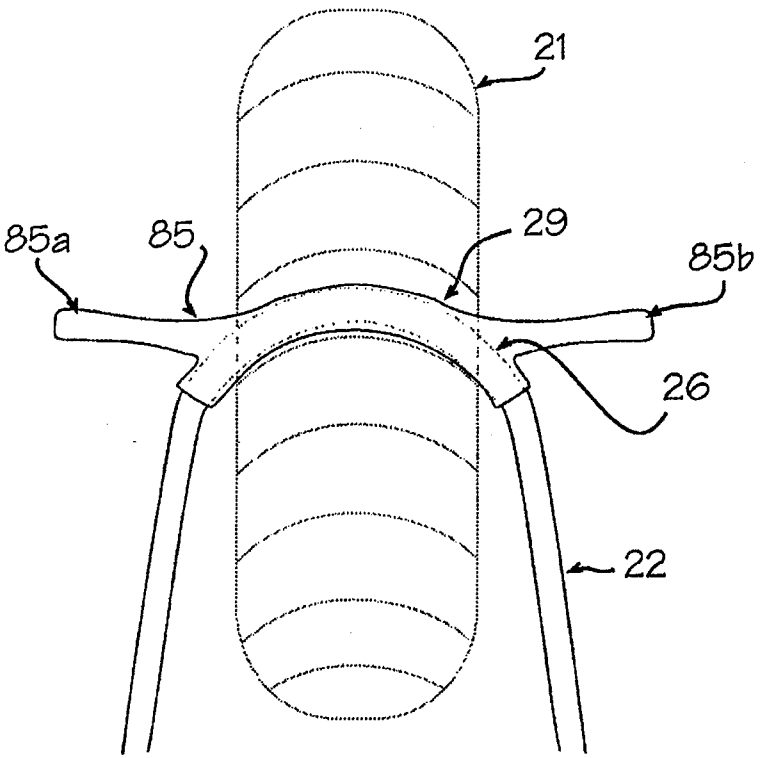
FIGS. 16*a* and 16*b* are partial top and side views, respectively, of connecting structures of the cable fastening system according to an alternate embodiment of the present invention.
Figure 16B:
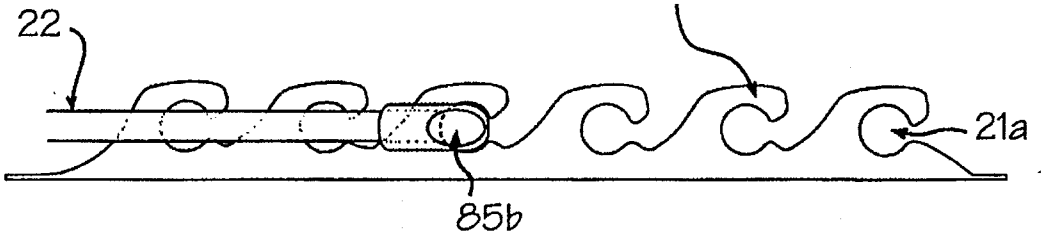

FIGS. 16*a* and 16*b* illustrate yet another variation on the construction of FIGS. 11*a* and 11*b*. Here, the pull-tab forms a T-extension 85 having opposing arms 85*a* and 85*b*, integrated with bridging member 29. As can be seen, tensioning or releasing cable 22 may be effected by grasping and pulling on T-extension 85.

Figure 17A:
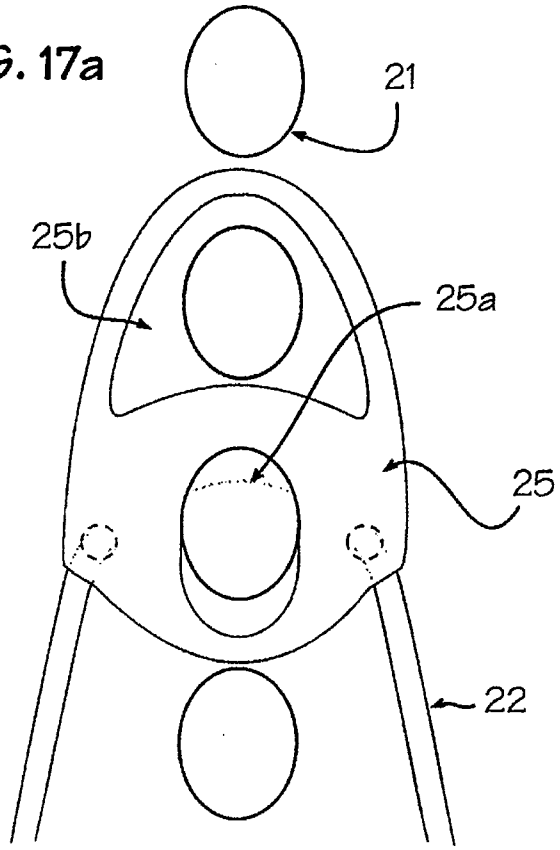
FIGS. 17*a* and 17*b* are partial top and side views, respectively, of connecting structures of the cable fastening system according to an alternate embodiment of the present invention.
Figure 17B:
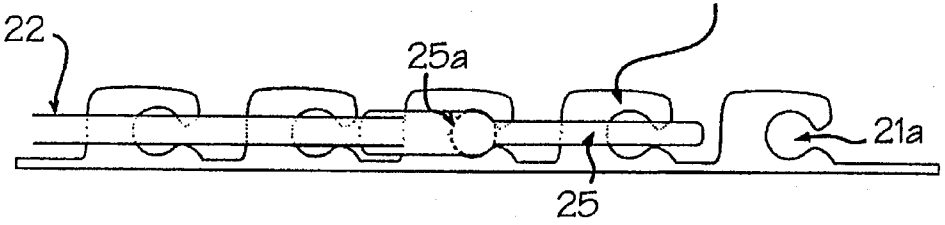

FIGS. 17*a* and 17*b* illustrate variations on the particular structure of the anchoring member 21 and pull-tab 25 for a closed-loop cable fastening system. The cable assembly including cable 22 and pull-tab 25 forms an effective closed-loop. The clip-in grooves 21*a* of anchoring member 21 are formed by locking protrusions 21*b*. Pull-tab 25 has a leading edge 25*a* shaped to snugly clip into grooves 21*a*, similar to the bridging member 29 shown in FIGS. 11*a*–16*b*.

Figure 18A:
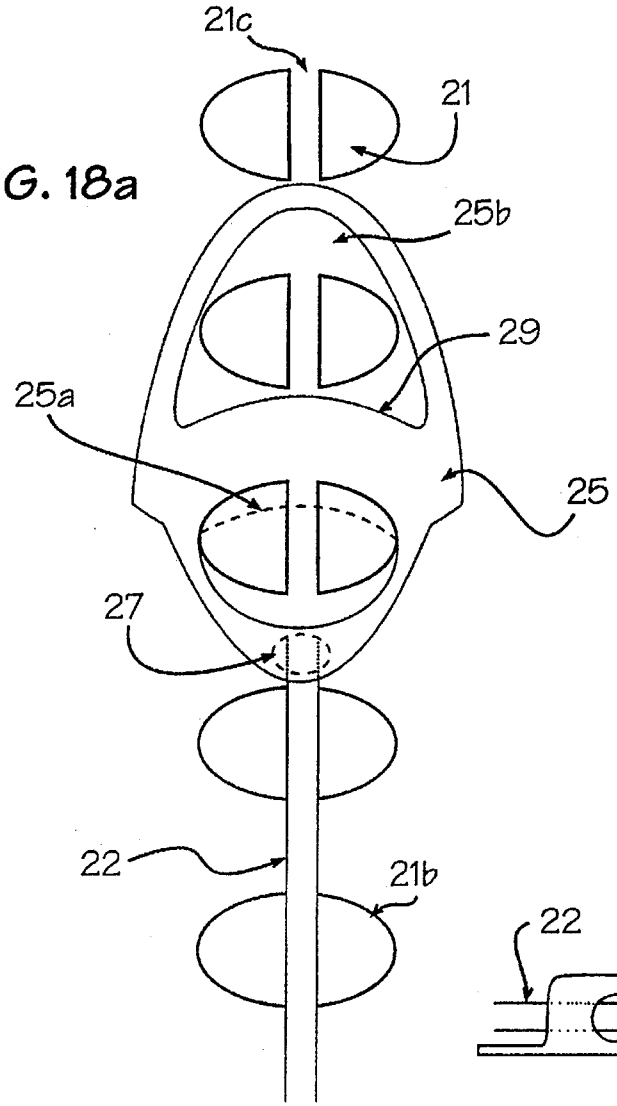
FIGS. 18*a* and 18*b* are partial top and side views, respectively, of connecting structures of the cable fastening system according to an alternate embodiment of the present invention.
Figure 18B:
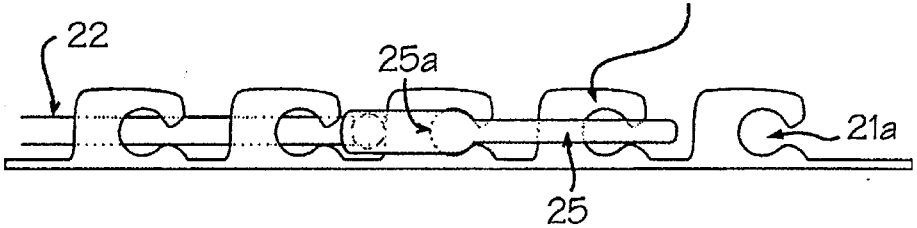

FIGS. 18*a* and 18*b* further illustrate variations on the particular structure of anchoring member 21 and pull-tab 25 illustrated in FIGS. 17*a* and 17*b*, adapted for a discrete length cable fastening system. As in the variation illustrated in FIGS. 17*a* and 17*b*, pull-tab 25 has a leading edge 25*a* shaped to snugly clip into clip-in grooves 21*a*. Clip-in grooves 21*a* are formed by locking protrusions 21*b*, each of which has a bifurcated structure forming through-passage 21*c* for free passage and seating of cable 22, as shown. Cable 22 may be secured to pull-tab 25 via a ball or plug terminal 27.

Pull tabs 25 in FIGS. 17*a* and 18*a*, are configured for the insertion of at least one finger hole 25*b* therethrough and may include consecutive finger holes located at the extended portion of the tab. Each finger hole generally fits the contour of the finger and seats properly within the structure of the anchoring members. This ensures that the tab is readily accessible to aid in the pulling force applied to the fastener along a direction substantially parallel to the tensioning direction of the guide members. Additional finger holes may be formed on tab 25 and may seat into locking protrusions to distribute the holding force of the anchoring member over a broader surface area when finger holes and locking protrusions are operable. Such multiple finger holes may include leading edges shaped to snugly clip into respective locking protrusions.

To assist in making various adjustments to the cable fastener system itself for application specific purposes, cables illustrated in FIGS. 1–18*b*, may be freely interchangeable and made of nylon, braided metallic cord, natural cord, an elastic material or a combination thereof, having a fixed length or differing elastic spring properties. To effect replacement of the cables, the guide members may have a cross section similar to that of the grooves of the anchoring member, such that the cable is securedly snapped therein.

Figure 19:
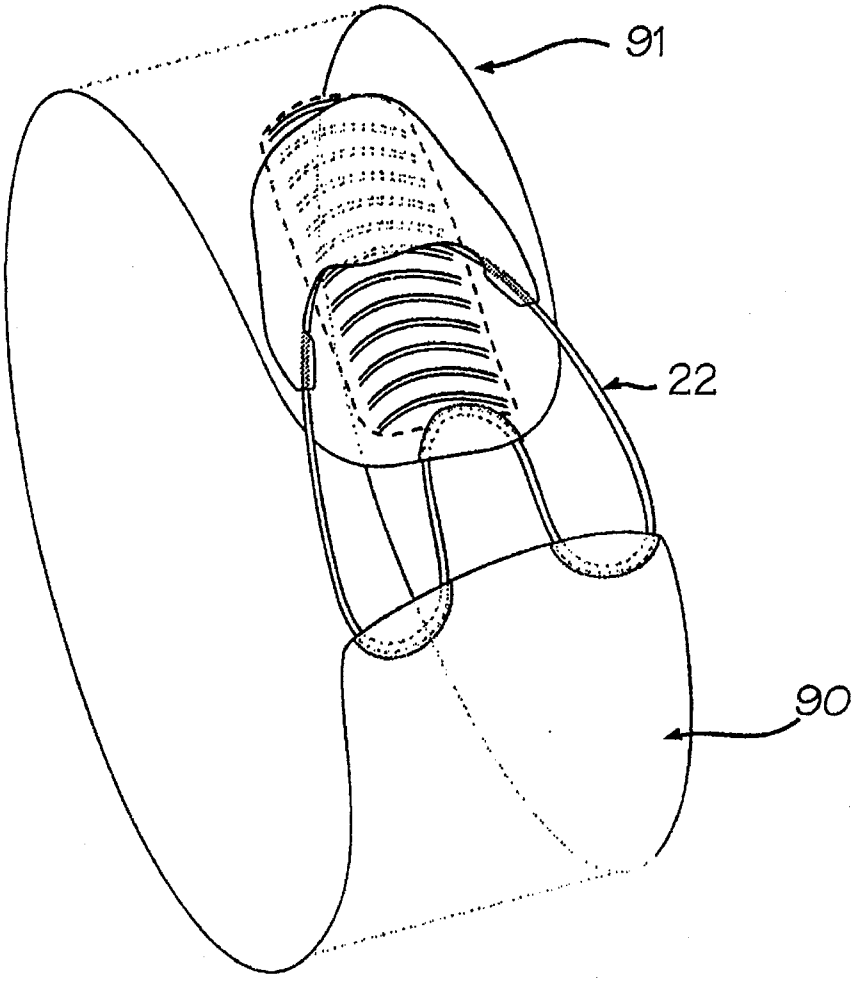
FIG. 19 is a lateral perspective view of a reusable cable fastening cinch incorporating the first embodiment of the cable fastening system according to the present invention in a closed position.

FIG. 19 shows an all purpose cable fastener cinch system 91, integrating the closed-loop cable fastener according to the first embodiment of the present invention with an all purpose strap 90, that may be utilized to carry out various cinching operations. As described above, cable 22 may be detached from the guide members, thereby severing the cable fastening system and increasing its scope of applications. For example, cable fastener cinch 91 may be utilized to safely secure sections of electrical conduit. The strap 90 may be formed of a woven natural material, and woven or extruded synthetic materials to form a strong, non-stretchable fastening system. Alternatively, the strap may be formed of a material having elastic properties.

The present disclosure is illustrative only, and changes may be made in detail, including matters of shape, size and arrangement of parts, within the principle of the invention, to the full extent intended by the broad general meaning of the terms in which the appended claims are expressed.

What is claimed is:

1. An adjustable fastening system, comprising:

opposing first and second cinching members that are adapted to be cinched together, said first cinching member including first and second spaced apart guide members, and said second cinching member including an opposing guide member that opposes the first and second guide members;

an effective closed-loop cable assembly connecting the first and second cinching members together, said cable assembly including a cable sequentially routing through said first guide member, said opposing guide member and said second guide member, said cable assembly extending from the first and second guide members to form a closed loop portion;

anchor means including an anchoring member for anchoring the cable assembly in a tensioned state thereby cinching said first and second cinching members together, said anchoring member forming at least one groove for receiving the closed loop portion of the cable assembly; and a pull tab attached to the cable, along the closed-loop portion.

2. The fastening system of claim 1, wherein said cable assembly further comprises a bridging member formed on and encasing said cable, along said closed-loop portion.

3. The fastening system of claim 1, wherein the pull-tab is integrated with a bridging member, said pull-tab and bridging member forming a pull-tab assembly forming the closed-loop portion of the cable, and said bridging member being adapted to securely seat in the at least one groove.

4. The fastening system of claim 1, wherein said cable assembly further comprises a bridging member to which said cable is secured, said bridging member forming the closed-loop portion.

5. The fastening system of claim 4, wherein said cable assembly further comprises two terminals secured to said cable, said two terminals being seated in the bridging member to connect the cable to the bridging member.

6. The fastening system of claim 1, wherein said pull-tab includes a leading edge that securely seats in the at least one groove.

7. The fastening system of claim 1, wherein said cable assembly further comprises two terminals secured to the cable and being seated within the pull-tab to connect the cable to the pull-tab.

8. The fastening system of claim 1, wherein said anchoring member includes a plurality of juxtaposed grooves for adjustably tensioning the cable assembly.

9. The fastening system of claim 8, wherein each of said juxtaposed grooves extends through a respective locking protrusion.

10. The fastening system of claim 1, wherein the cable is detachable from the guide members.

11. The fastening system of claim 1, wherein said fastening system has a purchase of at least 1:1.

12. The fastening system of claim 1, wherein said fastening system has a purchase of at least 2:1.

13. The fastening system of claim 1, wherein said cable is comprised of at least one material from the group consisting of nylon, braided metallic cord, natural cord and elastic material.

14. The fastening system of claim 1, wherein at least one of the guide members comprises a roller bearing around which said cable extends, said roller bearing being rotatable corresponding to translation of the cable.

15. The fastening system of claim 1, further comprising an additional intermediate guide member, and a third guide member provided between the first and second guide members.

16. The fastening system of claim 1, wherein said cable is slidable through at least the first and second guide members.

17. The fastening system of claim 1, further comprising a strap having first and second opposite ends forming the first and second cinching members, respectively.

18. An adjustable fastening system, comprising:

opposing first and second cinching members that are adapted to be cinched together, said second cinching member including a first guide member;

a connector assembly connecting the first and second cinching members together, said connector assembly comprising (i) a flexible discrete-length connector having first and second ends, said first end being secured to the first cinching member and said connector routing through the first guide member of the second cinching member and returning to said first cinching member, and (ii) a seating member connected to the second end of the connector; and anchor means including an anchoring member for anchoring said connector assembly in a tensioned state thereby cinching said first and second cinching members together, said anchoring member forming at least one groove for receiving the seating member of the connector assembly, wherein said seating member has an outer contour that has a shape complementary to an inner contour of the at least one groove, such that the seating member is securely seated therein.

19. An adjustable fastening system, comprising:

opposing first and second cinching members that are adapted to be cinched together, said second cinching member including a first guide member;

a connector assembly connecting the first and second cinching members together, said connector assembly comprising (i) a flexible discrete-length connector having first and second ends, said first end being secured to the first cinching member and said connector routing through the first guide member of the second cinching member and returning to said first cinching member, and (ii) a seating member connected to the second end of the connector;

anchor means including an anchoring member for anchoring said connector assembly in a tensioned state thereby cinching said first and second cinching members together, said anchoring member forming at least one groove for receiving the seating member of the connector assembly; and a pull-tab connected to and extending from the seating member.

20. The fastening system of claim 19, wherein said pull-tab is formed of a rigid material having a leading edge that securely seats in the at least one groove.

21. The fastening system of claim 18, wherein said anchoring member comprises a plurality of grooves.

22. The fastening system of claim 21, wherein each of the plurality of grooves extends through a respective locking protrusion.

23. The fastening system of claim 18, wherein said connector comprises a cable thereby forming a cable assembly.

24. The fastening system of claim 23, wherein said anchoring member includes a through-passage traversing the plurality of grooves, said through-passage receiving a portion of the cable extending from the seating member.

25. An adjustable fastening system, comprising:

opposing first and second cinching members that are adapted to be cinched together, said second cinching member including a first guide member, and said first cinching member including a second guide member opposing said first guide member;

a connector assembly connecting the first and second cinching members together, said connector assembly comprising (i) a flexible discrete-length cable having first and second ends, said first end being secured to the first cinching member and said cable routing through the first guide member of the second cinching member, extending from the first guide member, routing through the second guide member and returning to said second cinching member, whereby the fastening system forms a two-turn configuration, and (ii) a seating member connected to the second end of the cable; and anchor means including an anchoring member for anchoring said connector assembly in a tensioned state thereby cinching said first and second cinching members together, said anchoring member forming at least one groove for receiving the seating member of the connector assembly.

26. An adjustable fastening system, comprising:

opposing first and second cinching members that are adapted to be cinched together, said second cinching member including first and third guide members spaced apart from each other, and said first cinching member including a second guide member;

a connector assembly connecting the first and second cinching members together, said connector assembly comprising (i) a flexible discrete-length cable having first and second ends, said first end being secured to the first cinching member and said cable sequentially routing through the first guide member, said second guide member and said third guide member, and returning to said first cinching member, whereby the fastening system forms a three-turn configuration, and (ii) a seating member connected to the second end of the cable; and anchor means including an anchoring member for anchoring said connector assembly in a tensioned state thereby cinching said first and second cinching members together, said anchoring member forming at least one groove for receiving the seating member of the connector assembly.

27. The fastening system of claim 18, wherein said fastening system has a purchase of at least 1:1.

28. The fastening system of claim 18, wherein the fastening system has a purchase of at least 2:1.

29. An adjustable fastening system, comprising:

opposing first and second cinching members that are adapted to be cinched together, said second cinching member including a first guide member;

a connector assembly connecting the first and second cinching members together, said connector assembly comprising (i) a flexible discrete-length cable having first and second ends, said first end being secured to the first cinching member and said cable routing through the first guide member of the second cinching member and returning to said first cinching member, said cable being detachable from the guide member, and (ii) a seating member connected to the second end of the cable; and anchor means including an anchoring member for anchoring said connector assembly in a tensioned state thereby cinching said first and second cinching members together, said anchoring member forming at least one groove for receiving the seating member of the connector assembly.

30. The fastening system of claim 23, wherein said cable is comprised of at least one material from the group consisting of nylon, braided metallic cord, natural cord and elastic material.

31. An adjustable fastening system, comprising:

opposing first and second cinching members that are adapted to be cinched together along a cinching direction, said first cinching member including first and second spaced apart guide members, and said second cinching member including an opposing guide member that opposes the first and second guide members;

an effective closed-loop cable assembly connecting the first and second cinching members together, said cable assembly including a cable sequentially routing through said first guide member, said opposing guide member and said second guide member; and anchor means including an anchoring member for anchoring the cable assembly in a tensioned state thereby cinching said first and second cinching members together along said cinching direction along which the first and second cinching members approach each other, said anchoring member forming plurality of juxtaposed grooves for receiving the cable assembly, the grooves being spaced apart from each other along the cinching direction.

32. An adjustable fastening system, comprising:

opposing first and second cinching members that are adapted to be cinched together along a cinching direction, said second cinching member including a first guide member;

a connector assembly connecting the first and second cinching members together, said connector assembly comprising a flexible discrete-length connector having first and second ends, said first end being secured to the first cinching member and said connector routing through the first guide member of the second cinching member and returning to said first cinching member, the second end of the connector including a seating member; and anchor means including an anchoring member for anchoring said connector assembly in a tensioned state thereby cinching said first and second cinching members together along said cinching direction along which the first and second cinching members approach each other, said anchoring member forming a plurality of juxtaposed grooves for receiving the seating member of the connector assembly, the grooves being spaced apart from each other along the cinching direction.

* * * * *

UNITED STATES PATENT AND TRADEMARK OFFICE

CERTIFICATE OF CORRECTION

PATENT NO. : 5,647,104

DATED : July 15, 1997

INVENTOR(S) : Lawrence H. JAMES

It is certified that error appears in the above-identified patent and that said Letters Patent is hereby corrected as shown below:

In column 5, line 46, change "quite of variety" to --quite a variety--.

Signed and Sealed this

Thirty-first Day of March, 1998

*Attest:*

*Attesting Officer*

BRUCE LEHMAN

*Commissioner of Patents and Trademarks*